US005722014A

United States Patent [19]

Fike

[11] Patent Number: 5,722,014

[45] Date of Patent: Feb. 24, 1998

[54] ENHANCED CONTAINER AND METHOD FOR DISPENSING TONER AND SUPPLYING TONER TO AN IMAGE FORMING MACHINE

[75] Inventor: Laura A. Fike, Watertown, Mass.

[73] Assignee: Nashua Corporation, Nashua, N.H.

[21] Appl. No.: 733,563

[22] Filed: Oct. 28, 1996

Related U.S. Application Data

[60] Provisional application No. 60/020,171 Jun. 21, 1996.

[51] Int. Cl.[6] ..... G03G 15/04; G03G 15/08

[52] U.S. Cl. ..... 399/119; 220/211; 220/253; 222/DIG. 1; 222/167; 399/120; 399/262

[58] Field of Search ..... 399/119, 120, 399/258, 260, 262, 263; 141/363, 364; 222/DIG. 1, 167; 220/211, 253, 780, 795

[56] References Cited

U.S. PATENT DOCUMENTS

| | | | |
|---|---|---|---|
| 3,180,313 | 4/1965 | Eisner | 399/61 |
| 3,526,341 | 9/1970 | Johnston . | |
| 3,853,246 | 12/1974 | Dubois | 222/DIG. 1 |
| 3,915,208 | 10/1975 | Anderson . | |
| 4,060,105 | 11/1977 | Feldeisen et al. . | |
| 4,611,730 | 9/1986 | Ikesue et al. | 222/167 |
| 4,615,364 | 10/1986 | Kawata . | |
| 4,641,945 | 2/1987 | Ikesue et al. | 399/262 |
| 4,744,493 | 5/1988 | Ikesue et al. | 222/167 |
| 4,796,747 | 1/1989 | Kajiwara . | |
| 4,878,603 | 11/1989 | Ikesue et al. | 222/167 |
| 5,030,997 | 7/1991 | Michlin et al. . | |
| 5,257,077 | 10/1993 | Peters, Jr. et al. . | |
| 5,441,177 | 8/1995 | Yanagisawa . | |
| 5,495,323 | 2/1996 | Meetze, Jr. | 222/167 X |
| 5,557,381 | 9/1996 | Sakamoto et al. | 399/111 |
| 5,557,382 | 9/1996 | Tatsumi et al. | 399/262 |
| 5,589,919 | 12/1996 | Ikunami et al. | 399/262 |
| 5,627,631 | 5/1997 | Ichikawa et al. | 222/DIG. 1 |

FOREIGN PATENT DOCUMENTS

| | | |
|---|---|---|
| 58-097068 | 6/1983 | Japan . |
| 63-050876 | 3/1988 | Japan . |

*Primary Examiner*—Matthew S. Smith
*Attorney, Agent, or Firm*—Lahive & Cockfield, LLP

[57] ABSTRACT

An enhanced container for supplying toner to an image forming machine and a consequentially enhanced, toner dispensing method characterized by the utilization of a slip-clutched shutter plate, journaled in the free end of a container body, and operable to be manipulated, without positional constraints, through simple rotation of the container body itself.

28 Claims, 6 Drawing Sheets

ENHANCED CONTAINER AND METHOD FOR DISPENSING TONER AND SUPPLYING TONER TO AN IMAGE FORMING MACHINE

INTRODUCTION AND GENERAL STATE OF THE ART

This invention pertains to an enhanced toner supplying container and a consequentially enhanced method for supplying toner to an image forming machine.

The invention is characterized by the unique utilization of a slip-clutch mounting of a shutter plate at the open end of the container so as to enable automated displacement of this shutter plate between container closing, container opening, and container reclosing positions solely in response to rotation of the container body within the image forming machine and totally independent of separately operable, closure manipulating mechanisms.

RELATED APPLICATION

This application claims priority in relation to Applicant's Provisional Patent Application Ser. No. 60/020,171, filed Jun. 21, 1996, entitled "Enhanced Container For Dispensing Toner And Enhanced Method For Supplying Toner To An Image Forming Machine" and identifying Laura A. Fike as inventor.

EXEMPLARY PRIOR ART

Heretofore, as evidenced by prior techniques such as that embodied in the disclosure of Yanagisawa U.S. Pat. No. 5,441,177 (Aug. 15, 1995), assigned to Ricoh Company, Limited, a container concept has been presented which is characterized by a cap mounted shutter member. This shutter member is pivotally supported upon a stationary cap component of the Yanagisawa cartridge and requires a separate, machine-based, operating mechanism for manually or automatically opening and closing the cap-mounted shutter.

The present invention totally eliminates the complexities of the cap mounted shutter arrangement as proposed by Yanagisawa and significantly avoids the requirement for an auxiliary, shutter operating mechanism.

The present invention also notably departs from a variety of prior art techniques which, although not requiring the Yanagisawa cap mounted shutter and machine based operating mechanism, do involve the utilization of various forms of container shutter configurations. Representative, state of the art, U.S. patent disclosures of this nature are as follows:

| Country | Patent | Patent Issue Date | Inventor | Assignee |
|---|---|---|---|---|
| U.S. | 3,526,341 | September 1, 1970 | B. H. Johnston | |
| U.S. | 3,915,208 | October 28, 1975 | L. H. Anderson | Inforex, Inc. |
| U.S. | 4,060,105 | November 29, 1977 | Feldeisen et al | Xerox Corporation |
| U.S. | 4,615,364 | October 7 1986 | S. Kawata | Konishiroku Photo Industry Co., Ltd. |

In addition to the exemplary, U.S. patent disclosures set forth in the table above, the general state of the art is further exemplified by Japanese published patent applications as follows:

| Country | Publication Number | Publication Date | Inventor | Assignee |
|---|---|---|---|---|
| Japan | 63-50876 | March 3, 1988 | | |
| Japan | 58-97068 | June 9, 1983 | K. Shimatori | Minolta Camera Co., Ltd. |

Significantly, the state of the art as exemplified by the prior art items noted above consistently fails to suggest a basic inventive concept of the present invention, this concept being characterized by the use of a slip-clutch mounted shutter plate, rotatably secured at the free end of the container body, mounted independent of the container cap, operable without requiring a separate, actuating mechanism, and having positions determined without limiting rotational movement of the container body.

As to the unique, cap post secured, non-rotatable agitator featured in this invention, Applicant has noted the prior art Michlin et al U.S. Pat. No. 5,030,997 and Peters, Jr. et al U.S. Pat. No. 5,257,077 patents.

Michlin discloses a rotating body with a "free" agitator bar disposed within the body which undergoes a tumbling type of movement.

Peters, Jr. discloses an agitator spring which is disposed within a container body and not separately driven. Although this spring does not rotate as a result of a separate drive mechanism, it does rotate in response to the rotation of the toner body and thus differs in basic operating principle from the concept now under consideration.

Applicant is also cognizant of prior art such as Kajiwara U.S. Pat. No. 4,796,747 which broadly discloses the concept of a helical discharge assistant which is fixedly positioned relative to an outlet, with the container for material to be dispensed rotating around this fixed discharge assistant. However, this discharge assistant is not a spring nor related to a cartridge cap as herein contemplated.

A Dubois U.S. Pat. No. 3,853,246 has also been noted which discloses a toner discharge arrangement wherein a helical spring 60 is fixedly positioned within a rotatable discharge tube 24 mounted at the end of a container body. However, the Dubois spring member 60 is specifically positioned for the purpose of hindering the outflow of material (see col. 5, line 59) and thus does not function as a discharge assistant as presently contemplated.

Prior art such as Kurotaka et al U.S. Pat. No. 4,696,418 is also recognized which broadly discloses the concept of an elastic helical spring which is non-rotatably mounted within a rotating cartridge. However, the Kurotaka spring does not have a fixed end as in the present invention and thus "rolls free".

Significantly, none of the prior art noted in this discussion contemplates a toner cartridge including a fixed cap supported, helical agitator spring which is non-rotatably supported within a rotatable, smooth wailed, cylindrical cartridge body. Thus, Applicant's simplified toner movement inducing concept emerges free of the teachings and suggestions of the prior art.

SUMMARY OF THE INVENTION

In departing from the teachings of the prior art, and in providing an enhanced toner container and mechanism for supplying toner to an image forming machine, the present invention involves a basic, toner concept which may be summarized as follows:

Generic Slip-Clutch Shutter

A container for supplying toner to an image forming machine is contemplated which comprises:

a container cap including
- an opening operable to discharge toner from the container to an image forming machine;

a container body operable to contain toner to be dispensed through the container cap opening to the image forming machine, this container body having a longitudinal axis and including
- a cap connector rotatably securing the container body to the container cap for rotation about the container longitudinal axis,
- a shutter plate rotatably mounted directly on, and at an open end of, the container body for rotation about its longitudinal axis, relative to the container body and having
  - a transfer opening including
    - a toner receiving mouth on an interior side of the shutter plate in continuous communication with the interior of the container body and
    - a toner discharging mouth on the exterior side of the shutter plate in continuous communication with the exterior of the container body, and
  - a closure surface circumferentially displaced from the transfer opening and operable, when aligned with the container cap opening, to substantially close the container cap opening;

a slip clutch rotatably mounting the shutter plate at the aforesaid open end of the container body and operable to
- induce friction-induced rotation of the shutter plate about the longitudinal axis of said container body in response to rotation of the container body about its longitudinal axis and relative to the container cap, and
- permit such rotational movement of the container body about its longitudinal axis to continue with rotational movement of the shutter plate relative to the container cap being arrested;

a shutter position control device operable to define
- a first rotatable position of the shutter plate relative to the container cap wherein the shutter plate closure surface substantially closes the container cap opening, and
- a second rotatable position of the shutter plate relative to the container cap wherein the transfer opening of the shutter plate is substantially aligned with the container cap opening, thereby permitting discharge of toner from the interior of the container body through the container cap opening to an image forming machine;

the shutter plate being continuously operable
- to rotate about the longitudinal axis of the container body in one circumferential direction operable to move the shutter plate closure surface out of alignment with the container cap opening, and
- to rotate about this longitudinal axis in a second circumferential direction, opposite to the first circumferential direction, operable to bring the shutter plate closure surface into alignment with the container cap opening;

a container cap locking device carried by the container cap and operable to cooperate with the image forming machine to prevent rotation of the container cap relative to this machine; and a drive mechanism carried by the container body and operable to induce rotation of the container body when the container body is located within the machine.

Flexible Shutter

In the context of the foregoing basic concept, the present invention further contemplates an enhanced shutter plate configuration characterized by a flexible configuration which permits the shutter plate to be flexed, inserted in the container end, and then drawn partially back out so as to "snap" into journaled, slip-clutch cooperation with the container body end. This flexing shutter plate concept may be delineated as follows:

the slip clutch, included in the above noted toner container, comprises an annular rim integrally formed at the open end of the container body and has a central opening, with
- this annular rim defining a radially inwardly opening recess, operable to clutchingly receive the shutter plate; and the above noted shutter plate comprises an elastic, laterally flexible, disc operable to
- be laterally flexed and at least partially inserted through the slip clutch rim opening at least partially into the container body and into partial engagement with the slip clutch, and
- be at least partially axially withdrawn from the container body so as to restore the shutter plate to an unflexed condition, disposed in annular, friction clutch engagement with the annular rim.

Agitator

Additionally, and as a second aspect subordinate to the basic container concept noted above, the present invention further contemplates the utilization of a smooth walled, rotatable container body which cooperates with a cap pin-mounted, generally stationary agitator spring, with cooperation between the stationary, helically coiled agitator spring and the rotatable smooth walled container body being operable to effect longitudinal toner displacement, out of the container. This concept may be described as follows:

the container cap noted above includes
- an agitator spring end supporting post projecting generally axially of the container body and through the shutter plate, with the shutter plate being freely rotatable thereabout;

the above noted container body is laterally defined by a smooth walled cylindrical shell; and the container further includes a generally helically coiled, agitator spring extending axially within the container body and having a free end thereof fixedly engaged with the container cap mounting post; with the thus secured agitator spring being relatively fixed in position with respect to the container cap, with the smooth walled cylindrical shell of the container body being rotatable thereabout and cooperable with the agitator spring to induce generally axial movement of toner within the container body toward the transfer opening of the shutter plate, through the transfer opening of the shutter plate, and through the container cap opening.

Smooth Discharge Ramp

A third enhancement of the basic container concept noted above entails a cantilevered ramp arrangement operable to bridge the gap between the container cap outlet and a desired toner dispensing location, this specific configuration being delineated as follows:

the container cap noted above includes a cantilevered, sloping discharge ramp sloping generally longitudinally outwardly and downwardly, away from the container cap opening, when the toner container is mounted within the image forming machine and operable to define a smoothly configured, toner discharge ramp extending uninterruptedly from the container cap opening to a toner discharge location.

Combination Detailing

A combination concept, yielding enhanced results through merging of the three separate, subordinate inventive concepts noted, entails the following combination concept, in the context of the basic container invention:

the aforesaid slip clutch comprises an annular rim integrally formed at the open end of the container body and having a central opening, with this annular rim defining a radially inwardly opening recess, operable to clutchingly receive the shutter plate;

the shutter plate comprises an elastic, laterally flexible, disc operable to be laterally flexed and at least partially inserted through the slip clutch rim opening at least partially into the container body and into partial engagement with the slip clutch; and be at least partially axially withdrawn from the container body so as to restore the shutter plate to an unflexed condition, disposed in annular, friction clutching engagement with the annular rim;

the container cap includes an agitator spring end supporting post projecting generally axially of the container body and through the shutter plate, with the shutter plate being freely rotatable thereabout;

the container body is laterally defined by a smooth walled cylindrical shell;

the container further includes a generally helically coiled, agitator spring extending axially within the container body and having a free end thereof fixedly engaged with the container cap mounting post;

the thus secured agitator spring being relatively fixed in position with respect to the container cap, with the smooth walled cylindrical shell of the container body being rotatable thereabout and cooperable with the agitator spring to induce generally axial movement of toner within the container body toward the transfer opening of the shutter plate, through the transfer opening of the shutter plate, and through the container cap opening; and the container cap further includes a cantilevered, sloping discharge ramp sloping generally longitudinally outwardly and downwardly, away from the container cap opening, when the toner container is mounted within said image forming machine and operable to define a smoothly configured, toner discharge ramp extending uninterruptedly from the container cap opening to a toner discharge location.

Cartridge Consequences

In the context of the basic cartridge invention noted above, the invention is further characterized by a cartridge and mounting arrangement for the shutter characterized as follows:

the container cap comprises a cartridge closure and includes a toner discharge path providing an opening operable to discharge toner from the container to an image forming machine when installed therein;

the container body includes a slip clutch surface at its open end;

the slip clutch surface of the container body at its open end is disposed in frictional, slip clutching engagement with the shutter plate;

the slip clutch surface of the container body is operable to provide mounting of the shutter plate directly on, and at the open end of, the container body, and at least in part, define the slip clutch;

the shutter plate is free of mounting to the container cap whereby the slip clutching engagement of the slip clutch surface of the container body with the shutter plate is operable to effect the rotation of the shutter plate; and the container body open end is free of rotational and sealing engagement relative to a toner container receiving receptacle of the image forming machine when installed therein whereby toner is operable to be discharged sequentially from the container body through its open end and thence through the toner discharge path provided by the container cap, which toner discharge path is non-rotatably and non-sealingly disposed relative to the toner container receiving receptacle of the image forming machine when installed therein.

Enhanced Shutter

Again, in relation to the basic cartridge concept summarized above, the invention is further characterized by a more detailed and enhanced shutter configuration concept wherein the shutter is actuated through cooperation between the shutter and an agitator structure, i.e., the helical agitator spring in the preferred embodiment. This combination concept is characterized as follows:

the slip clutch surface of the container body comprises an annular surface facing generally radially inwardly toward the longitudinal axis of the body;

the shutter plate includes at least one slip clutch engaging surface which projects generally longitudinally of the aforesaid longitudinal axis, is spaced radially outwardly therefore, faces generally outwardly of this longitudinal axis, and frictionally engages the slip clutch surface in slip clutch driven relation therewith; and the toner container further includes an agitator generally fixedly secured within the container body, and operable to induce movement of toner within the container body toward the container body open end in response to rotation of the container body about the agitator; and the shutter position control device comprises a first, shutter stop member carried by the shutter plate and operable to define the above noted first rotatable position through engagement with the agitator; and a second, shutter stop member carried by the shutter plate and operable to define the aforesaid second rotatable position through engagement with the agitator.

In another approach to define this aspect of the invention, a toner container concept is presented wherein:

the container cap includes a toner discharge path providing the opening operable to discharge toner from the container to the image forming machine, when installed therein;

the container body includes a slip clutch surface at the open end;

the slip clutch surface of the container body at its open end is disposed in frictional, slip clutching engagement with the shutter plate; and the slip clutch surface of the container body is operable to provide the mounting of the shutter plate directly on, and at the open end of the container body, and at least in part, define the slip clutch.

In this concept, the slip clutch surface comprises an annular surface facing generally radially inwardly toward said longitudinal axis and the shutter plate includes at least one slip clutch engaging surface which projects generally longitudinally of the longitudinal axis, is spaced radially outwardly therefore, faces generally radially outwardly of the longitudinal axis, and frictionally engages the slip clutch surface in slip clutch driven relation therewith.

This toner container further includes an agitator which is generally fixedly secured within the container body, and operable to include movement of toner within the container body toward the container body open end in response to rotation of the container body about the agitator, and the shutter position control device includes a first, shutter stop member carried by the shutter plate and operable to define the aforesaid first rotatable position through engagement with the agitator; and a second, shutter stop member carried by the shutter plate and operable to define the above noted second rotatable position through engagement with the agitator.

Leaked Toner Cavity And Accumulator

The toner container of any embodiment of this invention may further include a generally annular, leaked-toner receiving cavity defined by cooperating portions of the container cap, the container body, and a circumferential edge portion of said shutter plate. This leaked-toner receiving cavity is operable to receive toner leaked from the interior of said container body past the slip clutch. Further, an elastically yieldable, annular, pressure relieving body is radially interposed between the container body and the container cap and defines an elastically yieldable closure for the leaked-toner receiving cavity. This elastically yieldable closure is operable to at least partially relieve pressure resulting from an accumulation of leaked toner in the leaked-toner receiving cavity.

Discharge Assistant (Agitator) And Outflow Control

In a broad sense, a new inventive concept is presented in relation to the agitator spring and shutter and their flow controlling, cooperating relationship defined in the following terms:

A toner container concept is also herein presented which is operable to contain toner for discharge to an image forming machine, this toner container comprising:

a toner container body;

a toner discharge assistant disposed within the container body and operable to influence displacement of toner within the container body toward an end thereof; and a toner outflow control operable to control the flow of toner through the container end and out of the container in response to engaging cooperation of toner outflow control with the toner discharge assistant.

This particular container concept may be further characterized and enhanced by:

an actuating mechanism operable to effect the engaging cooperation of the toner outflow control in response to rotational movement of the toner container about the toner discharge assistant.

Agitator Spring (Discharge Assistant) Deployment

Finally, independent significance is attached to a cartridge configuration characterized by a toner container including a unique agitator spring deployment concept characterized as follows:

A container is herein contemplated for supplying toner to an image forming machine, the container comprising:

a container closure cap including an opening operable to discharge toner from the container to an image forming machine;

a container body operable to contain toner to be dispensed through the container cap opening to the image forming machine, this container body having a longitudinal axis and including a cap connector rotatably securing the container body to the container cap for rotation about the aforesaid longitudinal axis;

a container cap locking device carried by the container cap and operable to cooperate with an image forming machine to prevent rotation of the container cap relative to the machine;

a drive mechanism carried by the container body and operable to induce rotation of the container body when the container body is located within the machine;

the container cap including an agitator spring-end support, the container body being laterally defined by a smooth walled cylindrical shell; and a generally helically coiled, elastic, agitator spring extending axially within the container body having a free end thereof fixedly engaged with the container cap agitator spring-end support;

the thus secured agitator spring being relatively fixed in position with respect to the container cap, with the smooth walled cylindrical shell of the container body being rotatable thereabout and cooperable with the agitator spring to induce generally axial movement of toner within the container body toward and through the container cap opening.

Common Aspects

In all embodiments of this invention, the shutter plate is free of mounting to the container cap whereby the slip clutch is operable to effect rotation of the shutter plate. Moreover, in all of these embodiments, the container body open end is free of rotational and sealing engagement relative to a toner container receiving receptacle of the image forming machine, when installed therein, whereby toner is operable to be discharged sequentially from the container body through its open end and through the toner discharge path provided by the container cap. This toner discharge path remains non-rotatably and non-sealingly disposed relative to the toner container receiving receptacle of the image forming machine when installed therein.

Method Aspects

Method counterparts of each of the toner cartridge configurations noted above provide method improvements in a toner dispensing operation, corresponding to operative aspects of the enhanced toner container configurations as noted above. As will be recognized, these method counterpart concepts correlate with the basic apparatus concepts noted above, as well as the subordinate and combined subordinate apparatus concepts described in detail.

In describing the various embodiments of the invention as summarized above, reference will be made to structural configurations illustrated in the appended drawings.

DRAWINGS

As shown in the drawings:

FIG. 1 provides a fragmentary, partially sectioned depiction of a toner container installed in a photocopy machine with a machine-based toner container holder being depicted in phantom line;

FIG. 2 provides a perspective, exploded view of container body, shutter plate, and container cap components of the FIG. 1 assembly with the container cap being partially "broken-away" to reveal internal details; and FIG. 3 provides a plan view illustration of the flexible shutter plate incorporated in the FIG. 1 assembly;

FIG. 4 provides a sectional view of the assembled component portion depicted in exploded, perspective view in FIG. 2 along view direction "4", thereby illustrating interior structural relationships of these components;

FIG. 5 provides a fragmentary, enlarged view of slip-clutch defining end rim of the toner container body.

FIG. 6 provides a fragmentary, partially sectioned view of an enhanced shutter mounting and actuating mechanism incorporated in the basic container, i.e., cartridge, of this invention;

FIG. 7 provides an external plan view of the shutter mechanism of the FIGURE 6 illustration, viewing FIG. 6 in the view direction A—A;

FIG. 8 provides a fragmentary view of the shutter mechanism depicted in FIG. 7, viewed generally in the direction B—B of FIG. 7;

FIG. 9 provides an end elevational view of the closure cap engaging end of the resilient, helically coiled agitator spring or discharge assistant which is incorporated in the FIG. 6 assembly;

FIG. 10 provides a side elevational view of the agitator or discharge assistant of FIG. 9;

FIG. 11 provides an end elevational view of the FIG. 10 agitator or discharge assistant, viewing the spring from the outer or closed end of the cartridge body;

FIG. 12 provides a partially sectioned inclined angle view of the FIG. 6 cartridge assembly, viewed from the interior of the cartridge and looking forwardly toward the shutter end of the cartridge from the right cartridge/shutter side of FIG. 7 at somewhat of an angle and illustrating the shutter in the closed or toner preventing position of FIG. 7;

FIG. 13 provides a modified form of the FIG. 12 view, illustrating the shutter after it has been manipulated to an or toner dispensing position, in conformance with the position shown in FIG. 6; and FIG. 14 provides an enlarged fragmentary view of the converging mouth portion of the agitator cross member receiving and securing pin of the closure cap of the FIG. 6 assembly as viewed generally along section line 14—14 of FIG. 6.

Having delineated the illustrative aspects of the appended drawings, it is now appropriate to give further, more detailed consideration to structural characteristics of the embodiments of this invention as heretofore summarized.

DETAILED DESCRIPTION OF EMBODIMENTS

Figure 1:
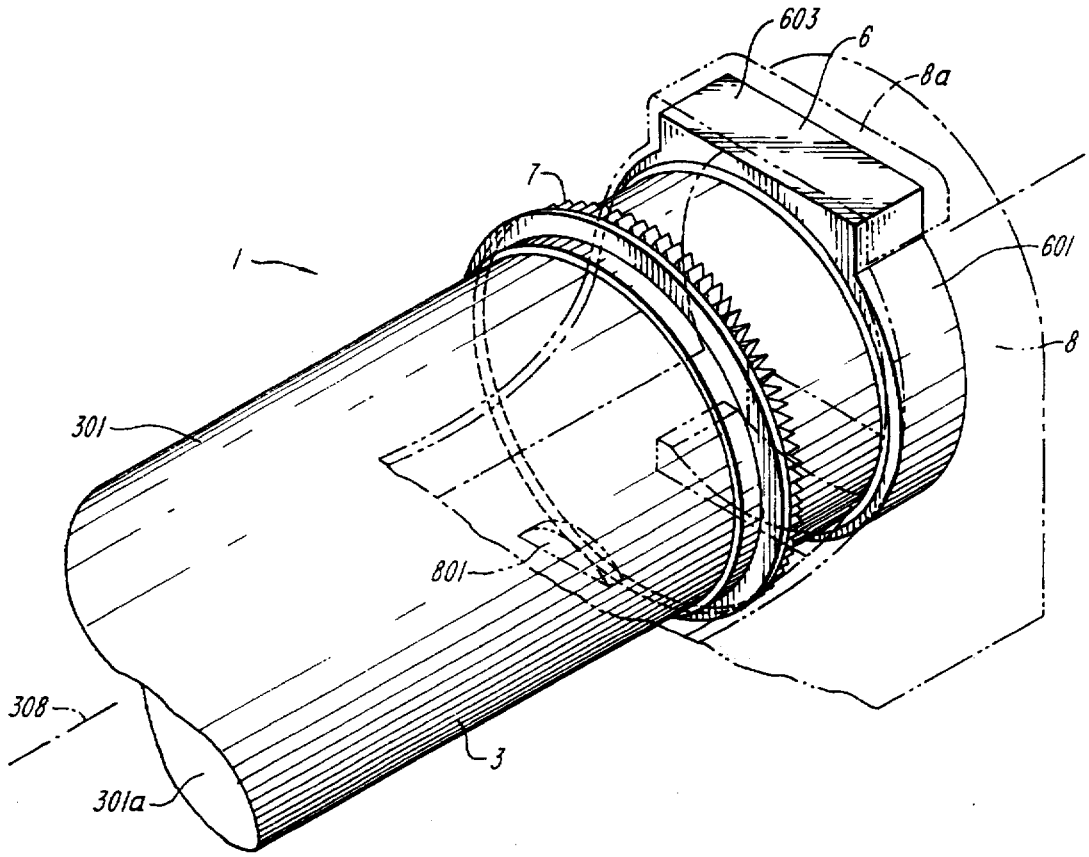

In describing the invention, the overall characteristics of the invention will be summarized, following which the invention, in its various ramifications, will be summarized in the context of independently significant container aspects of the invention and finally with respect to independently significant, method aspects of the invention.

Slip-Clutch Shutter

Basic elements of the apparatus of the present invention may be summarized as follows:

| Component | Reference Numerals Used In Drawings |
|---|---|
| Toner Container | 1 |
| Toner Container End Assembly (Fixed) | 2 |
| Toner Container Body (Rotary) | 3 |
| Toner Container Slip Clutch Rotatably Supporting A Shutter Plate And Mounted Wholly On The Container Body 3 | 4 |
| Position Control For Shutter Plate | 5 |
| Container Cap Including Cap Locking Device | 6 |
| Drive Mechanism (Gear Mounted On Container Body) For Rotating Container Body Relative To Fixed Cap | 7 |

Figure 8:
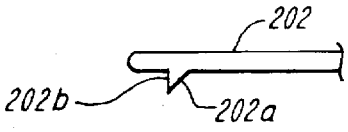
Figure 9:
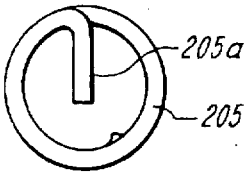
Figure 10:
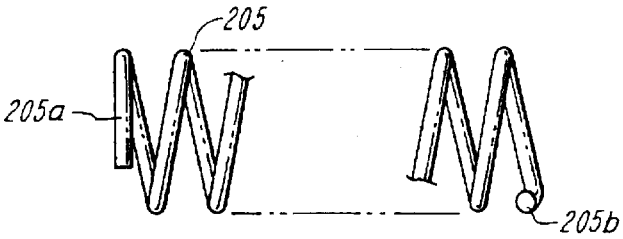
Figure 11:
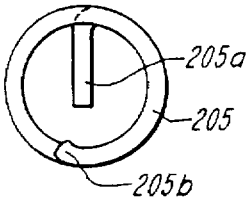

The container assembly 1 as described above is intended for utilization in an image forming machine 8. Image forming machine 8, shown in FIGS. 1 and 8 in phantom lines, may include a container holder 8*a* such as that depicted in the Yanagisawa U.S. Pat. No. 5,441,177 noted above except that the Yanagisawa shutter operating mechanism mounted in the holder and intended by Yanagisawa to be utilized for manipulating a cap mounted shutter, would be redundant or unnecessary and thus could be eliminated in its entirety.

Container 1 and its various components may be fabricated of the usual type of plastic materials employed in the fabrication of toner containers for image forming machines such as photocopiers.

Figures 2, 5:
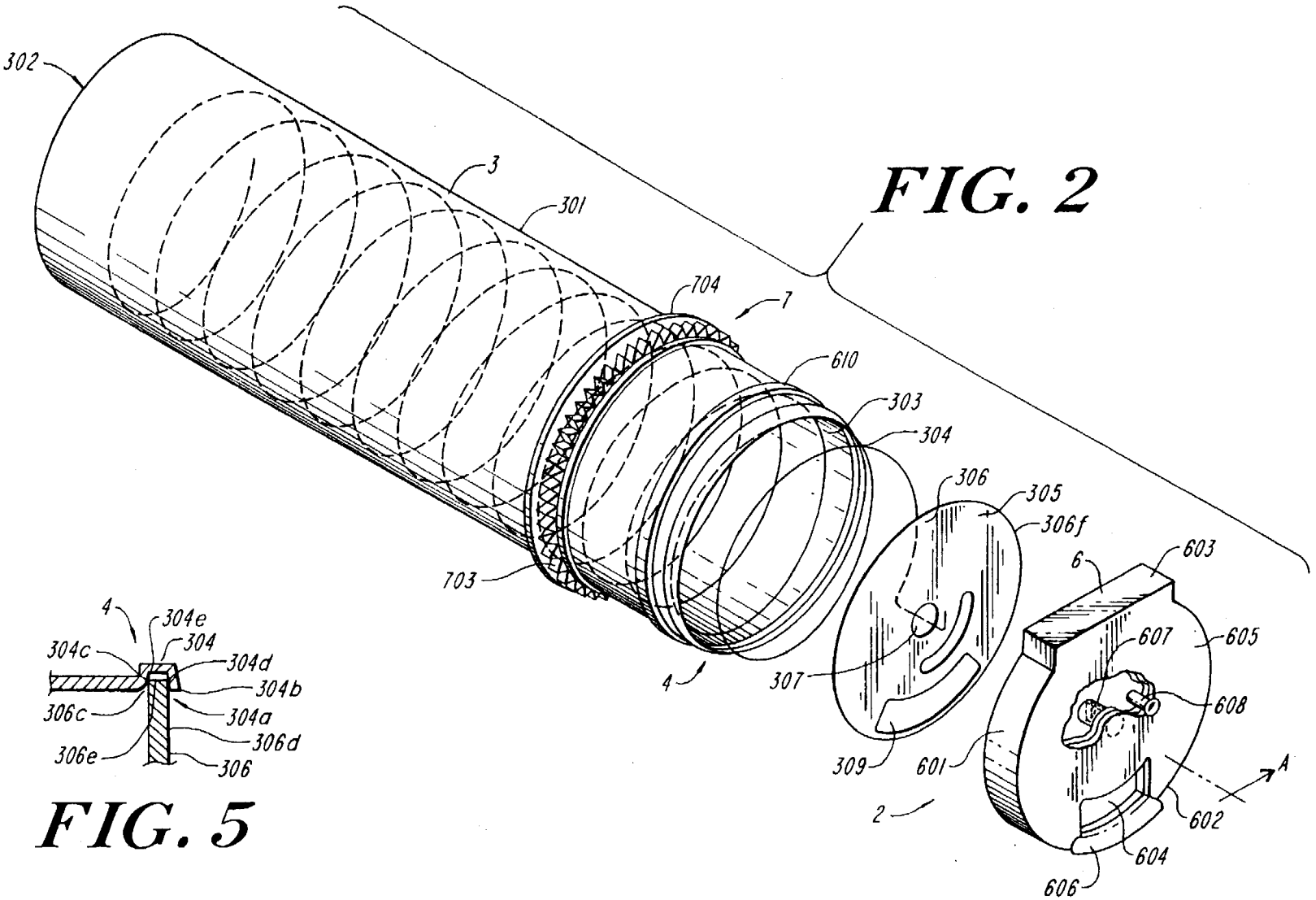
Figure 4:
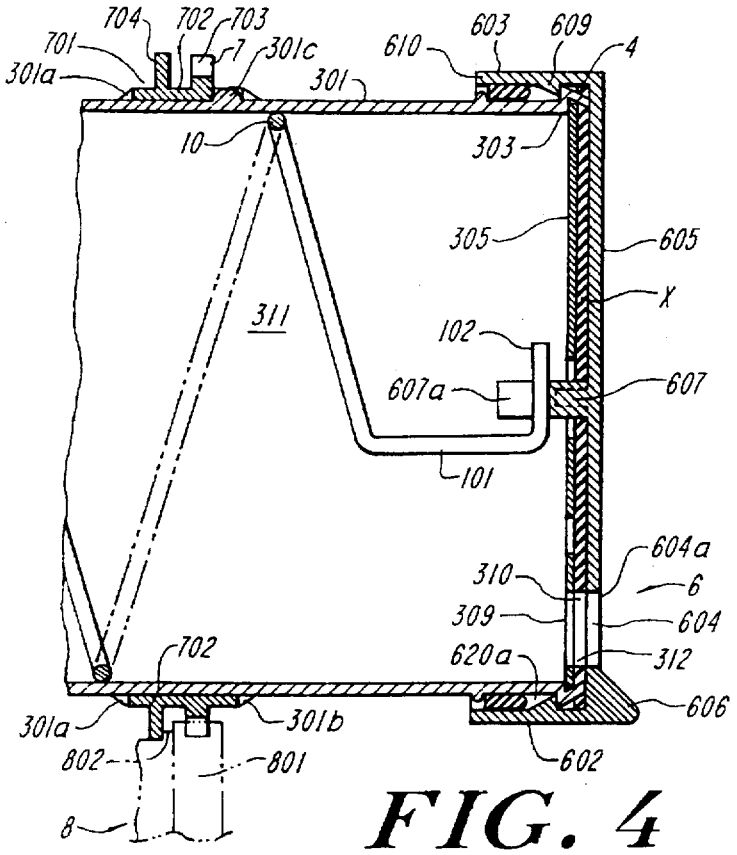

As is shown in FIGS. 1, 2 and 4, the container cap 6, which defines the end assembly 2, is defined by a generally cylindrical side wall 601 which extends from a lower portion 602 of the installed cap upwardly to a locking or cap securing abutment 603. Abutment 603 is operable to be slidably received within a correspondingly shaped recess in the holder 8*a*, as generally described in the aforesaid Yanagisawa patent, so as to permit the cap to be secured against rotation or fixed within the machine 8 while the cylindrical body 3 is rotated relative to the fixed cap.

Cap 6 includes an opening 604, located on the lower portion of the cap when installed in the machine. Opening 604 is located at a radially lower most location on a transverse end wall 605 of the cap 6 so as to define a lower most toner outlet. A cantilevered, generally radially and outwardly downwardly extending, ramp-like, projection 606 extends outwardly from the wall 605 so as to define a smooth, non-concave discharge path for toner leaving the container 1 and moving from the container to a desired toner receiving zone within the machine 8.

Container cap 6 further includes a centrally and axially inwardly projecting agitating spring mounted post 607 which is operable to frictionally engage and thereby secure an end of an agitator spring 10 through receiving a spring end tang 102 in a post recess 607*a*. This recess may have a wide opening and taper to afford friction gripping of an inserted spring end 102, hereinafter described.

Cap 6 is further provided with a pin like projection 608, which may be fabricated of metal or plastic, and which is radially offset from the center post 607. Pin 608, although not supporting or mounting the shutter plate 306 mounted in the container body (to be hereinafter described), does serve to cooperate with a circumferentially extending and radially off-centered slot 314 formed in the shutter plate to provide a position control device 5 operable to define container "open" and "closed" positions within the machine.

Container body 3 is defined by a cylindrical, smooth walled cylindrical body portion or shell 301 which terminates at one end in a closed transverse wall 302 and terminates at the opposite machine inserted end 303 in an open mouthed configuration. Container 3, at its open end 303 includes an annular rim 304 which defines a radially inwardly projecting recess 304*a* which is operable to rotatingly and frictionally secure, in a slip-clutch manner, a disc 305 defining a container body-mounted shutter plate 306. Rim 304 also provides a central opening 304*b* operable to receive a flexed disc 304 for shutter plate installation purposes.

The disc 305, which defines shutter plate 306, is fabricated from elastically flexible material such as thin plastic or metal, thereby permitting the disc body 305 to be partially laterally folded so as to be inserted into the open mouth 303 with an edge portion of the disc 305 partially engaging the recess 304*a*. By then engaging the partially inserted shutter disc 305, for example at a central opening 307, and pulling outwardly, the folded and partially inserted disc 305 will be snapped into full, circumferential, slip-clutching engagement with the opening 304*a* of the rim 304.

In this way, the rim 304 of the body 3 and its radially inwardly opening recess 304*a* define a slip clutch 4 mounting for the shutter disc 306, thereby permitting continuous relative rotation in either direction of the disc 305, i.e., the shutter plate 306, about the longitudinal central axis 308 of the container body 3.

Figure 3:
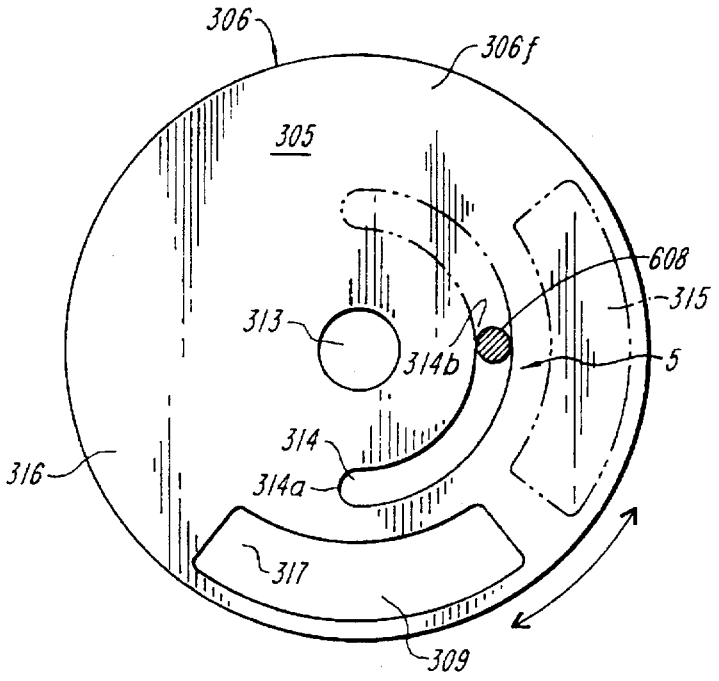

The shutter plate 306 is provided with a transfer opening 309 near the radial periphery, as generally shown in FIGS. 2, 3 and 4. Transfer opening 309 includes a toner receiving mouth 310 which is on the interior side of the shutter plate 306 and in continuous communication with the interior 311 of the cartridge 3. Transfer opening 309 is further provided with a toner discharging mouth 312 on the exterior side of the shutter plate 306 and operable to provide continuous communication with the exterior of the container body, i.e., the area external of the assembled shutter plate 305 and container shell 301.

Shutter plate 306 further includes a central opening 313 which is operable to telescopingly receive the mounting post 607 of the cap 6 which defines the toner container end assembly 2.

In addition, shutter plate 306 further includes a shutter position controlling, (i.e., shutter plate arresting), circumferentially extending slot 314 which is radially located between the radial positions of the axis of opening 313 and the circumferential periphery of the outlet opening 309. As is shown in FIGS. 3 and 4, shutter arresting slot 314 telescopingly receives the cap pin 608 and cooperates therewith to define a shutter arresting or position controlling device 5. With the components thus assembled, clockwise rotation of the shutter plate 306, induced by the friction clutch driving action of the friction clutch of the of the container body, will cause the plate 306 to rotate clockwise (as shown in FIG. 3) about the longitudinal container body axis 308 away from a first rotatable position (depicted by the phantom line position 315 of the toner opening 309 in FIG. 3) where the outer body surface 316 of the shutter plate 306 defines a closure surface, operable to close the cap opening 604. (Normally, cap opening 604 would be closed by surface 316 at the time of installation of container 1 in holder 8.) This will bring opening 309 to the second, open container position 317 when opening 309 and 604 are aligned.

Because of the slip clutch 4, even with the shutter plate 306 located in this container outlet closing position, rotation of the body 3 about its longitudinal axis 308 may continue, unabated.

Rotation of the container body in a reverse or counterclockwise direction will serve to move the opening 309 away from the lower most, second position 317 shown in FIG. 3, (i.e., the second rotatable position of the shutter plate 306 relative to the container cap 6 wherein the transfer opening 309 of the shutter plate is substantially aligned with the container cap opening 604 thus permitting the discharge of toner from the interior 311 of the body 3 through the container cap opening to an appropriate toner receiving zone of the image forming machine 8) back to the toner closing position 315 wherein disk surface 316 closes opening 604. Here again, by virtue of the slip clutch mechanism 4 supporting the shutter plate 306, this container reclosing action permits rotation of the container to be continued unabated, even after container reclosing is effected.

As will be appreciated slot end 314*a* cooperates with pin 608 to define the closed container condition, with cooperation between slot end 314*b* and pin 608 defining the open container position, shown in FIG. 3.

In order to facilitate the axial transfer of toner out of the interior 311 of the container body 3, the container 1 is provided with a drive gear assembly 7 and an interiorly disposed, generally fixably position, helically coiled, agitator spring 10.

Drive gear mechanism 7, as shown in FIG. 4, is fixedly secured on the exterior of the cylindrical wall 301. This fixed securing may be effected by forming the gear 7 as an integral portion of the container body 3 or by providing a separate, generally annularly configured ring gear assembly 701 which is telescoped over the cylindrical wall 301 into the locked position shown in FIG. 4, non-removably secured between annular securing abutments 301*a* and 301*b*. The relative elasticity of the container body 301 may permit the ring 701 to be snapped over the sloping outer periphery of at least one of the mounting abutments 301*a* so as to be telescoped into non-removable cooperation with the container wall 301. In the event that this telescoping mounting is employed, one or more longitudinally extending anti-rotation abutments 301*c* may be provided on the container wall 301 to generally longitudinally engage anti-rotation, mating recesses on the periphery of the mounting plate 702 of the gear unit 7.

Drive mechanism 7 is provided with a cylindrical container wall encircling ring gear 703 which may mesh with and cooperate with a drive gear 801 in the image forming machine 8 in order to effect rotation of the container body 3 about its longitudinal axis 308 within the machine 8, with the cap 6 being stabilized against rotation, as above described.

Gear assembly 7 may also include a motion stabilizing, annular rim 704 which is engagable with a cylindrical support surface 802 carried by gear 801 of the holder 8*a* in the image forming machine. This mounting and drive arrangement conforms to that described in the above noted Yanagisawa et al U.S. Pat. No. 5,441,177.

The helical, stationary agitator spring 10, left-hand coiled as shown in FIG. 2, may extend within the interior space 311 generally throughout the length of the interior space 311, from the closed end 302, to the open end 303. The spring 10, which may be fabricated of metal or plastic and may be round or polygonal in cross section, defines a helical, flow inducing mechanism within the interior space 311. When the container is appropriately rotated so as to frictionally induce circumferential movement of toner toward surfaces of the spring 10 facing and sloping axially toward the cap 6, frictional interaction between the thus motivated toner mass and the spring 10 will tend to cammingly induce axial outward flow of toner toward the cap outlet 604.

The shutter disc 305 may then be manipulated into position, as above described. A shutter seal x, of rubber, foam, felt, or plastic, may be interposed between wall 605 and the disc 305, as shown in FIG. 4.

In assembling the components of this mechanism, it is contemplated that the spring 10 will be inserted into the container interior 311, generally as shown in FIG. 4, with the spring end 101 providing a transversely extending tang 102 which is operable to be received within the slot 607*a* of the spring mounting post 607. This connection may be facilitated by appropriate, inward tapering of the slot 607*a* away from its open end or mouth, as generally shown in FIG. 14 in connection with the FIGS. 6–14 embodiment.

The cap 6 may thus be manipulated into position with sloping, circumferentially spaced lugs 609, formed on the interior of the cap wall 602, being operable to snap over and thus lockingly and rotatably engage the slip clutch defining rim 304 and the spring end 102 engaged in post slot 607*a*. Rotary engagement between the thus secured cap 6 and the container body 3 may be effected by an annular accumulator (possibly fabricated of foam such as neoprene) 610 carried on the container body and circumferentially interpositioned between the fixed cap 6 and the rotatable body wall 301.

Prior to effecting the final snap-action engagement between the lug 609 and the slip clutch-defining rim, the tang 102 will have then been manipulated into agitator spring securing engagement with the pin recess 607*a*.

With the components assembled as shown, the assemblage provides a generally annular, leaked-toner receiving cavity 620 defined by cooperating portions of the container cap 6, the open end of the container body 3, and a circumferential edge portion 304*a* of the shutter plate. This leaked-toner receiving cavity 620 is operable to receive toner leaked from the interior of said container body 3 past the slip clutch 4 of this assembly.

Further, there is provided an elastically yieldable, annular, pressure relieving body in the form of resilient accumulator 610 which is radially interposed between the container body 3 and the container cap 6 and defines an elastically yieldable, annular end closure for the leaked-toner receiving cavity 620. This elastically yieldable accmulator 610 is operable to at least partially relieve pressure resulting from an accumulation of leaked toner in the leaked-toner receiving cavity 620.

The body, shutter, and cap components of the container or cartridge 1 may be fabricated from appropriate plastic material in accordance with the conventional practices of the toner cartridge industry.

Summary of Apparatus Aspects of First Embodiment of Invention

Basic Container Concept

The basic container for supplying toner to an image forming machine as presented herein comprises the following concept.

A container cap 6 is provided with an opening 604 operable to discharge toner from the container to an image forming machine 8.

A container body 3 is provided which is operable to contain toner to be dispensed through the container cap opening 604 to the image forming machine 8, this container body having a longitudinal axis 308 and including

- a cap connector 609 rotatably securing the container body to the container cap for rotation about its longitudinal axis 308,
- a shutter plate 306 rotatably mounted directly on, and at an open end 303 of, the container body 3 for rotation about its longitudinal axis, relative to the container body and having
  - a transfer opening 309 including
    - a toner receiving mouth 310 on an interior side of the shutter plate 306 in continuous communication with the interior of the container 311 body 3 and
    - a toner discharging mouth 312 on the exterior side of the shutter plate 306 in continuous communication with the exterior of the container body, and
  - a closure surface 316 circumferentially displaced from the transfer opening 309 and operable, when aligned with the container cap opening, to substantially close the container cap opening.

A slip clutch 4 rotatably mounting the shutter plate 306 is provided at the open end of the container body and is operable to

- induce friction-induced rotation of the shutter plate 306 about the longitudinal axis 308 of the container body 3 in response to rotation of the container body 3 about its longitudinal axis and relative to the container cap 6, and
- permit such rotational movement of the container body 3 about its longitudinal axis to continue with rotational movement of the shutter plate 306 relative to the container cap being arrested.

The shutter position control device as noted above is operable to define

- a first rotatable position 315 of the shutter plate relative to the container cap wherein the shutter plate 306 closure surface substantially closes the container cap opening 604, and
- a second rotatable position 317 of the shutter plate 306 relative to the container cap 6 wherein the transfer opening 309 of the shutter plate 306 is substantially aligned with the container cap opening 604, thereby permitting discharge of toner from the interior of the container body through the container cap opening 604 to the image forming machine 8.

The shutter plate 306 remains continuously operable

- to rotate about the container body's longitudinal axis in one circumferential direction operable to move the shutter plate closure surface 316 out of alignment with the container cap opening 604, and to rotate about this longitudinal axis 308 in a second circumferential direction, opposite to the first circumferential direction, operable to bring the shutter plate closure surface 316 into alignment with the container cap opening 604.

The container cap locking device 603 carried by the container cap 6 is operable to cooperate with the image forming machine 8 to prevent rotation of the container cap 6 relative to this machine.

Finally, a drive mechanism 7, carried by the container body, is operable to induce rotation of the container body 3 when the container body 3 is located within said machine 8.

Flexible Shutter

The flexible shutter plate concept of the FIGS. 1–5 embodiment of the invention entails:

- the slip clutch 4 (FIG. 5) comprising an annular rim 304 integrally formed at the open end of the container body and having a central opening 304*b*, with
  - this annular rim 304 defining a radially inwardly opening recess 304*a*, operable to clutchingly receive the shutter plate 306; and
- the shutter plate 306 comprising an elastic, laterally flexible, disc 305 operable to
  - be laterally flexed and at least partially inserted through the slip clutch rim opening 304*b* at least partially into the container body 301 and into partial engagement with the slip clutch 4, and
  - be at least partially axially withdrawn from the container body 301 so as to restore the shutter plate 306 to an unflexed condition, disposed in annular, friction clutch engagement with the annular rim 304.

Fixed Agitator With Smooth Walled, Rotary Container Body

The smooth wailed, cylindrical, rotary container body 301 uniquely effects toner discharge through a combination wherein:

- the container cap 6 includes
  - an agitator spring end supporting post 607 projecting generally axially of the container body and through the shutter plate 306, with the shutter plate being freely rotatable thereabout;
- the container body 3 is laterally defined by smooth walled cylindrical shell and
- the container further includes a generally helically coiled, agitator spring 10 extending axially within the container body and having a free end 102 thereof fixedly engaged with the container cap mounting post 607.

The thus secured agitator spring 10 is relatively fixed in position with respect to the container cap 6, with the smooth walled cylindrical shell 301 of the container body being rotatable thereabout and cooperable with the agitator spring 10 to induce generally axial movement of toner within the container body 3 toward the transfer opening 309 of the shutter plate, through this transfer opening of the shutter plate, and through the container cap opening 604.

Cantilevered Discharge Ramp

In order to avoid the forming of pockets of toner externally of the toner container, the container cap 6 includes a cantilevered, sloping discharge ramp 606 sloping generally longitudinally outwardly and downwardly, away from the container cap opening 604, when the toner container is mounted within the image forming machine 8. This ramp is operable to define a smoothly configured, toner discharge ramp extending uninterruptedly from the container cap opening to a toner discharge location.

Summary of Method Aspects of First Embodiment of Invention

Basic Method Concept

The basic method presented through this invention for supplying toner to an image forming machine comprises:

- providing a container cap 6 including
  - an opening 604 operable to discharge toner to an image forming machine 8;
- providing a container body 3 containing toner to be dispensed through the container cap opening 604 to the image forming machine 8, this container body having a longitudinal axis 308 and including
  - a cap connector 609 rotatably securing the container body 3 to the container cap 6 for rotation about the container body's longitudinal axis,
  - a shutter plate 306 rotatably mounted directly on, and at an open end 303 of, the container body for rotation about its longitudinal axis, relative to the container body 3 and having
    - a transfer opening 309 including
      - a toner receiving mouth 310 on an interior side of the shutter plate in continuous communication with the interior 311 of the container body 3 and
      - a toner discharging mouth 312 on the exterior side of the shutter plate 306 in continuous communication with the exterior of the container body 3, and
    - a closure surface 316 circumferentially displaced from the transfer opening 309 and operable, when aligned with the container cap opening 604, to substantially close the container cap opening 604;
- providing a slip clutch 4 rotatably mounting the shutter plate 306 at the open end of the container body and operable to
  - induce friction-induced rotation of the shutter plate 306 about the longitudinal axis 308 of the container body 3 in response to rotation of the container body 3 about its longitudinal axis and relative to the container cap 6, and
  - permit such rotational movement of the container body 3 about its longitudinal axis 308 to continue with rotational movement of the shutter plate 306 relative to the container cap 6 being arrested;
- providing a shutter position control device 5 operable to define
  - a first rotatable position 315 of the shutter plate 306 relative to the container cap wherein the shutter plate closure surface 316 substantially closes the container cap opening 604, and
  - a second rotatable position 317 of the shutter plate 306 relative to the container cap 6 wherein the transfer opening 309 of the shutter plate is substantially aligned with the container cap opening 604, thereby permitting discharge of toner from the interior 311 of the container body 3 through the container cap opening 604 to the image forming machine 8;
- the aforesaid shutter plate 306 being continuously operable
  - to rotate about the container body's longitudinal axis 308 in one circumferential direction operable to move the shutter plate closure surface 316 out of alignment with the container cap opening 604, and to rotate about this longitudinal axis 308 in a second circumferential direction, opposite to the first circumferential direction, operable to bring the shutter plate closure surface 316 into alignment with the container cap opening 604;

providing a container cap locking device 603 carried by the container cap 6 and operable to cooperate with the image forming machine 8 to prevent rotation of the container cap 6 relative to this machine 8; and providing a drive mechanism 7 operable to induce rotation of the container body 3 when the container body 3 is located within the image forming machine 8.

Flexibly Inserted Shutter

A subordinate method invention is presented herein relating to a flexible shutter plate. In this method aspect:

in the slip clutch 4, there is provided an annular rim 304 integrally formed at the open end 303 of the container body, this rim having a central opening **304*b*, with this annular rim defining a radially inwardly opening recess 340*a*, operable to clutchingly receive the shutter plate; and through the flexibility of the shutter plate, there is provided an elastic, laterally flexible, disc 305 operable to be laterally flexed and at least partially inserted through the slip clutch rim opening 304*b* at least partially into the container body 3 and into partial engagement with the slip clutch 304*a*, and be at least partially axially withdrawn from the container body 3 so as to restore the shutter plate 306 to an unflexed condition, disposed in annular, friction clutch engagement with the annular rim 304**.

Fixed Agitator Supported By Cap Within Smooth Walled, Rotary Container Body

Another subordinate method aspect of this invention pertains to an agitation technique comprising:

in the container cap 6, providing an agitator spring end 102 supporting post 607 projecting generally axially of the container body and through the shutter plate 306, with the shutter plate 306 being freely rotatable thereabout;

the container body 3 being laterally defined by a smooth walled cylindrical shell 301; and within the container 1, providing a generally helically coiled, agitator spring 10 extending axially within the container body 3 and having a free end 102 thereof fixedly engaged with the container cap mounting post 607; with the thus secured agitator spring 10 being relatively fixed in position with respect to the container cap 6, and the smooth walled cylindrical shell 301 of the container body being rotatable thereabout and cooperable with the agitator spring 10 to induce generally axial movement of toner within the container body 3 toward the transfer opening 309 of the shutter plate, through this transfer opening of the shutter plate, and through the container cap opening 604.

Providing Smooth Discharge Ramp

In another subordinate method aspect, toner accumulating pockets external of the container cap are avoided by a method as follows:

in the aforesaid container cap 6, providing a cantilevered, sloping discharge ramp 606 sloping generally longitudinally outwardly and downwardly, away from the container cap opening 604, when the toner container 1 is mounted within the image forming machine 8 and operable to define a smoothly configured, toner discharge ramp 606 extending uninterruptedly from the container cap opening 604 to a toner discharge location.

Container End Mounted Shutter and Leaked Toner Accumulator

In each of the first embodiment of the invention shown in FIGS. 1 through 5 and in the modified toner container shown in FIGS. 6 through 14, this invention contemplates the possible inclusion of a leaked toner receiving cavity and also possibly an accumulator. This concept will now be summarized in relation to FIGS. 1 through 5. In this concept a cartridge concept is presented wherein:

the container cap 6 includes a toner discharge path 604 providing the opening **604*a* operable to discharge toner from the container 1 to the image forming machine 8**, when installed therein;

the container body 301 includes a slip clutch surface (two such inclined surfaces **304*c* and 304*d* and/or the radial surface 304*e* of FIG. 5** may function as such) at the open end;

the slip clutch surface of the container body 3 at its open end 303 is disposed in frictional, slip clutching engagement with the shutter plate 306; and the slip clutch surface of the container body 3 is operable to provide the mounting of the shutter plate 306 directly on, and at the open end 303 of the container body 3, and at least in part, define the slip clutch 4.

In this embodiment, the slip clutch surface may comprise an annular surface facing, at least in part, generally radially inwardly toward the longitudinal axis 308 and the shutter plate 306 includes at least one slip clutch engaging surface **306*c*, 306*d*, or 306*e* (FIG. 5) which projects generally longitudinally of the longitudinal axis 308, is spaced radially outwardly therefrom, faces, at least in part, generally radially outwardly of the longitudinal axis 308**, and frictionally engages the slip clutch surface in slip clutch driven relation therewith.

This toner container further includes an agitator 10, functioning as a discharge assistant, and which is generally fixedly secured within the container body 3, and operable to include movement of toner within the container body 3 toward the container body open end 303 in response to rotation of the container body about the agitator 10.

This toner container further includes a generally annular, leaked-toner receiving cavity 620 defined by cooperating portions 603 of the container cap 6, end 303 of the container body 3, and a circumferential edge portion **306*f* (FIG. 3) of the shutter plate 306. This leaked-toner receiving cavity 620 is operable to receive toner leaked from the interior of said container body3 past the slip clutch 4**.

Further, an elastically yieldable, annular, pressure relieving body 610 may be radially interposed between the container body 3 and the annular portion 603 of the container cap 6 and define an elastically yieldable, annular end closure for the leaked-toner receiving cavity 620. This elastically yieldable accumulator member 610 would be operable to at least partially relieve pressure resulting from an accumulation of leaked toner in the leaked-toner cavity 620.

Presently Preferred Enhanced Shutter Configuration

An especially enhanced shutter configuration for the cartridge of this invention is depicted in FIGS. 6, 7, 12 and 13.

In describing this enhanced structure, reference will be made to the following components:

| Component | Reference Numerals |
|---|---|
| Enhanced Shutter Configuration Cartridge | 200 |
| Container Clutch Surface | 201 |
| Shutter (Without Stop Engaging Slot) | 202 |
| 3 Slip Clutch Lugs of Shutter | 202a |
| Radial Clutching Faces of Clutch Lugs 202d | 202b |
| 3 Snap-on Fittments to Journal Cap | 203 |
| Journaling Recess on Body to Receive Snap Fittments 203 | 204 |
| Spring - Left Hand Wound | 205 |
| Cross Bar Post of Spring | 205a |
| Tucked-in Spring End | 205b |
| Spring Sides | 205c |
| Closed Position Stop on Shutter | 206 |
| Open Position Shutter Stop on Shutter | 207 |
| Shutter Opening for Toner Discharge | 208 |
| Drive Gear for Container Body | 209 |
| Closure Cap (Without Stop Pin) | 210 |

As shown in FIGS. 6, 7, 12, and 13, the enhanced shutter configuration 200 of the presently preferred embodiment of this invention entails an arrangement wherein the shutter plate is simply pressed-fitted into frictional engagement with the end 303 of the container body 3.

This is accomplished through the utilization of a modified shutter plate 202 which is operable to be mounted in press fitting engagement with a generally radially inwardly facing annular surface 201 formed at the end of the container body 3. This press fitting engagement is facilitated by the presence of three circumferentially displaced lugs 202*a*, generally symmetrically disposed and equally spaced about the axis of rotation 308 of the shutter 202 and providing radially outwardly facing slip clutching surfaces 202*b* on each of the slip clutching lugs 202*a*. The surfaces 202*b* are operable to frictionally engage the clutch plate-defining surface 201 so as to provide press fitting and friction clutch driving cooperation between the shutter 202 and the surface 201 of the body 3.

As in the case of the initially described embodiment, the closure cap 210 is operable to be journaled in snap-fitting engagement with the container body 3. This may be accomplished, as shown in FIGS. 6, 7, 12 and 13, through the utilization of cap-provided, snap-fittment lugs 203 formed on the cartridge cap 6 and which are operable to resiliently snap into a circumferentially extending, cap mounting recess 204 formed on the body 3 of the cartridge behind rim portion 304. With this arrangement, the cap may be simply axially pressed over the installed shutter into snap fitting cooperation with the body 3, so as to bring the cap fittments 203 into resilient engagement with the journaling recess 204. During this assembly, the spring mounting post 607 will be positioned so that the spring receiving, transverse groove 607*a* receives the cross portion 205*a* of the left-handedly wound, agitator spring 205 so as to relatively immobilize this spring end with respect to the rotatable cartridge body 3. With the components thus assembled, the opposite or far end 205*b* of the spring 205 may be provided with a slightly "tucked-in" portion, i.e., a portion bent axially back toward the from end of the container and possibly inwardly toward the axis of rotation of the cylinder so as to ensure that a sharp spring end does not engage the end wall of the container and induce wear or damage during toner dispensing operations. This outer spring end 205*b* is disposed adjacent the base wall 302 of the container 3, preferably in nominal contacting relation therewith.

As is shown in FIGS. 6, 7, 12, and 13, enhanced shutter plate 202 may be provided with a pair of shutter position defining, stop members 206 and 207.

Stop members or lugs 206 and 207 comprise circumferentially displaced lug members projecting generally axially from the side of the shutter plate 202 facing the interior of the cartridge body 3. Stops or lugs 206 or 207 are circumferentially displaced by an arc approximately equal to 90° plus the thickness of the spring cross or mounting bar 205*a*, such that these stop members are engagable on opposite sides of the spring bar 205*a* in response to 90° rotational movement of the plate 202.

Figure 6:
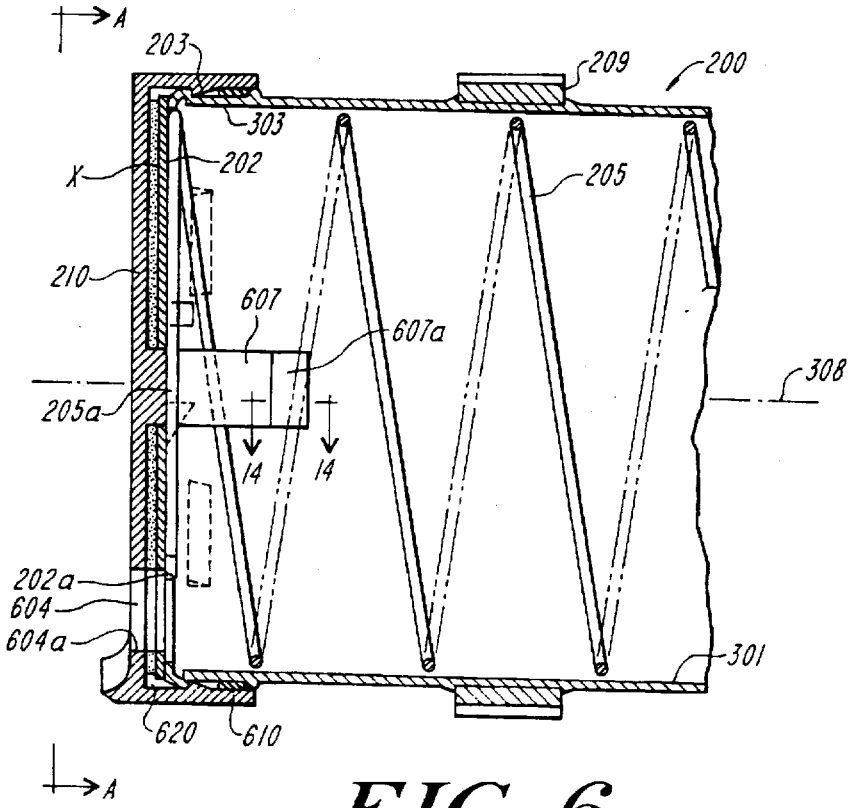
Figure 7:
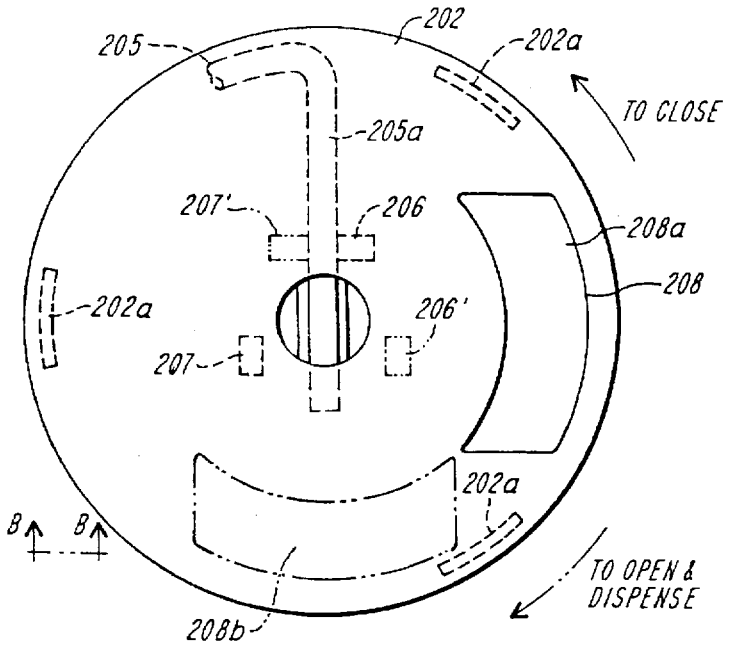
Figure 12:
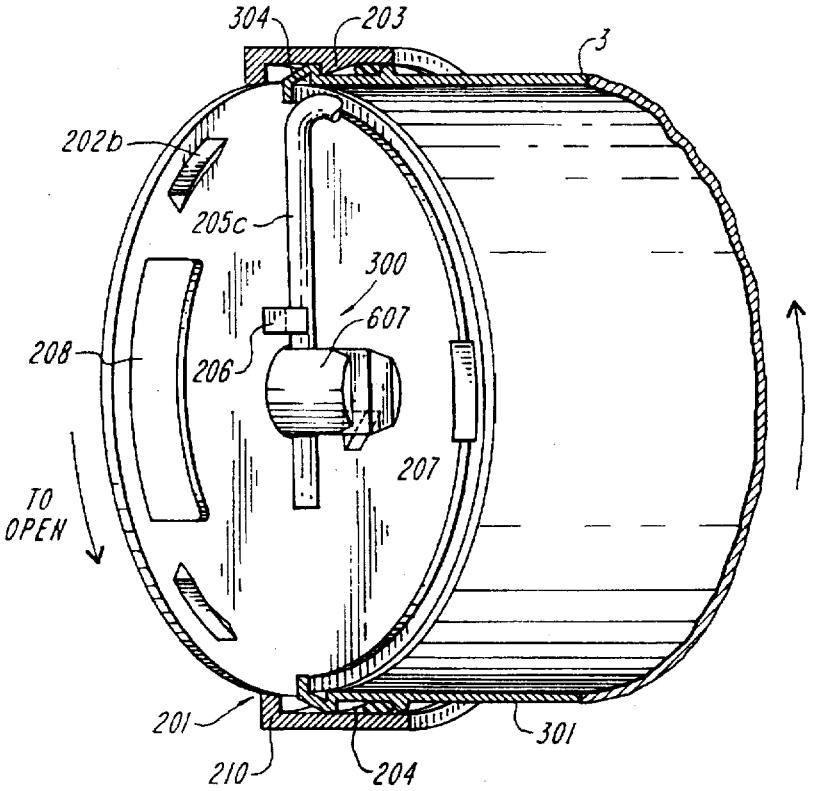
Figure 13:
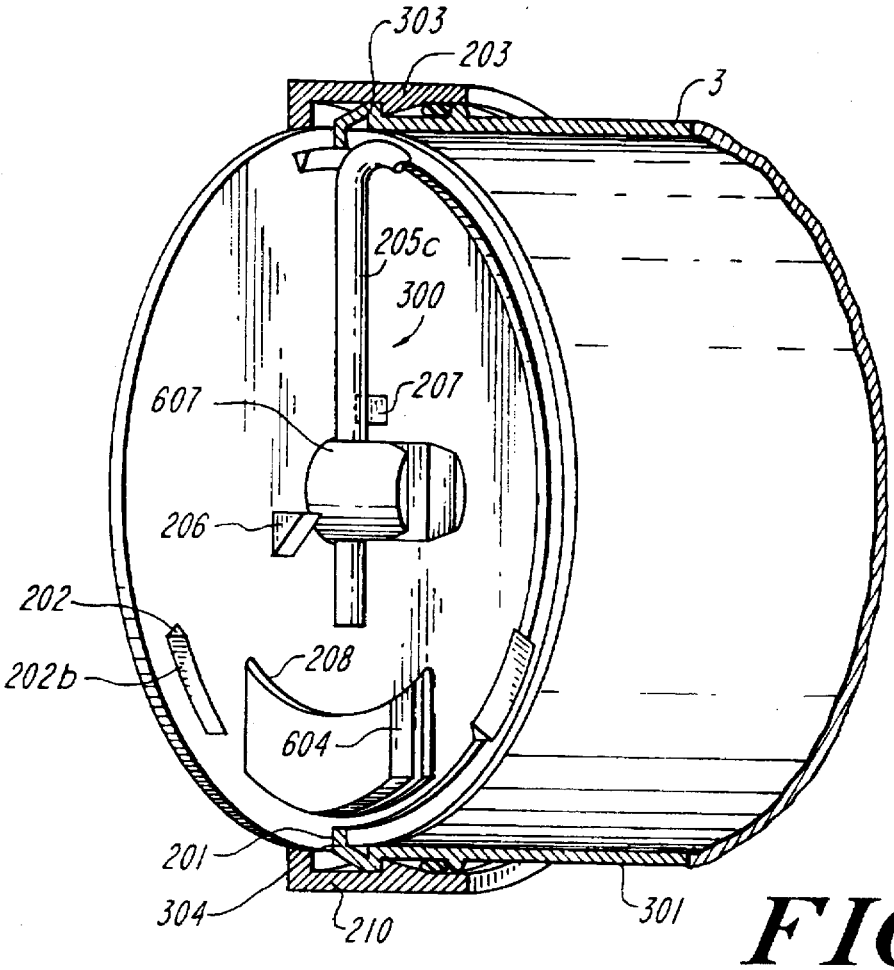
Figure 14:
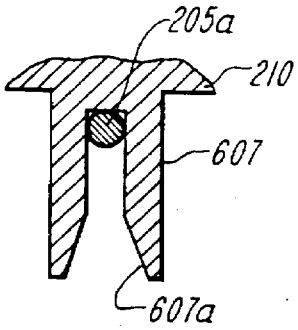

Thus, as shown in FIGS. 6, 7, 12, and 13, in the enclosed shutter position, stop 206 will engage one 205*b* side of the spring cross member 205*a* when the assembly is viewed as shown in FIGS. 7 and 12. Clockwise rotation of the container, through friction-clutching cooperation of the surface 201 of the body and the clutching lugs 202*a* of the shutter, will rotate the shutter so as to cause the lug 207 to engage the opposite side 205*c* of the spring cross member 205*a*, thereby bringing the shutter opening 309 into toner dispensing, aligned cooperation with the cap opening 604, as shown in FIGS. 6 and 13.

In the FIGS. 6 and 13 "open" position of shutter 202, shutter opening 208 will be disposed at location 208*b*, shown in FIG. 7, with stop lugs 206 and 207 positioned as shown in this FIGURE. In the FIGS. 7 and 12 "closed" position of the shutter 202, stops 206 and 207 will be disposed at locations 206' and 207' respectively, as shown in FIG. 7, with opening 208 being disposed as shown at position 208*a*, displaced from the cap opening 604.

Such manipulation of the shutter from the closed to open conditions is effected by imparting rotation to the drive gear 209 immovably associated with the cartridge 200. This non-removable ring gear associated with the cartridge body 3 provides a fixedly positioned, permanently associated cartridge body drive mechanism operable to rotate the cartridge 1 in a clockwise direction for toner dispensing and shutter opening purposes. Manual or machine induced manipulation of the cartridge body in an opposite direction during cartridge removing operations will serve to rotate the cartridge body and shutter plate 202 in an opposite or counter clockwise rotation, restoring engagement of the stop 206 with the spring cross member 205 and thereby displacing the shutter opening 309 from the cap opening 604, reclosing the cartridge, and preventing the outflow of toner.

Because of the left handed winding of the spring 205 and the clockwise, dispensing direction of movement of the shutter plate (as viewed facing the exterior of the shutter 202), the toner mass within the container body 3 will be frictionally dragged through frictional cooperation with the smooth interior shell-wall of the container body 3 in a clockwise direction into camming cooperation with the side portions 205*c* of the coil spring 205. These coil spring portions define cam surfaces facing the oncoming direction of dragged toner and sloping away from this direction, toward the shutter end 305 of the cartridge 1. Thus, the dragged toner will be cammed through its engagement with the spring 205 and be induced to move generally axially toward the cartridge outlet. In this sense, the helical spring 205 functions much as an agitator while not requiring separately imparted agitator movement. In addition, the coil spring functions as a toner displacing or discharge assistant device without requiring the presence of rotatable spiral ribs or other moving configurations.

In other respects, the enhanced configuration depicted in FIGS. 6 through 14 will function essentially in accordance with the mode of operation and image forming machine installation as the configuration illustrated and described in connection with FIGS. 1 through 5.

Summarizing apparatus aspects of this cartridge, these configurations may be overviewed as follows:

A toner container 200 is presented wherein:

the container cap 210 includes a toner discharge path 604 providing an opening 604*a* operable to discharge toner from the container to an image forming machine 8 when installed therein;

the container body 3 includes a slip clutch surface 201 at its open end 303;

the slip clutch surface 201 of the container body 3 at its open end 303 is disposed in frictional, slip clutching engagement with the shutter plate 202;

the slip clutch surface 201 of the container body 3 is operable to provide the mounting of the shutter plate 202 directly on, and at the open end 303 of the container body 3, and at least in part, define the slip clutch 4;

the shutter plate 202 is free of mounting to the container cap 6 whereby the slip clutching engagement of the slip clutch surface of the container body with the shutter plate is operable to effect the rotation of the shutter plate; and the container body open end 303 is free of rotational and sealing engagement relative to a toner container receiving receptacle 8*a* of the image forming machine 8 when installed therein whereby toner is operable to be discharged sequentially from the container body 3 through its open end 303 and through the toner discharge path 604 provided by the container cap, which toner discharge path is non-rotatably and non-sealingly disposed relative to said toner container receiving receptacle 8*a* of said image forming machine 8 when installed therein.

A toner container as above described may be further characterized in that:

the container cap 6 includes a toner discharge path 604 providing the opening operable to discharge toner from the container to an image forming machine when installed therein;

the container body 3 includes a slip clutch surface 201 at its open end 303;

the slip clutch surface 201 of the container body 3 at its open end 303 is disposed in frictional, slip clutching engagement with the shutter plate 602;

the slip clutch surface 201 of the container body 3 is operable to provide the mounting of the shutter plate 202 directly on, and at the open end 303 of the container body 3, and at least in part, define the slip clutch 4;

the shutter plate 202 is free of mounting to the container cap 6 whereby the slip clutching engagement of the slip clutch surface 201 of the container body 3 with the shutter plate 202 is operable to effect the rotation of the shutter plate; and the container body open end 303 is free of rotational and sealing engagement relative to a toner container receiving receptacle 8*a* of the image forming machine 8 when installed therein whereby toner is operable to be discharged sequentially from the container body 3 through the open end and through the toner discharge path 604 provided by the container cap 210, which toner discharge path is non-rotatably and non-sealingly disposed relative to the toner container receiving receptacle 8*a* of the image forming machine 8 when installed therein; and the toner container 1 further includes a generally annular, leaked-toner receiving cavity 620 defined by cooperating portions of the container cap 6, the container body 3, and a circumferential edge portion 202*c* (FIG. 6) of the shutter plate 202, the leaked-toner receiving cavity 620 being operable to receive toner leaked from the interior of the container body 3 past the slip clutch 4.

A toner container as described above may further comprise:

an elastically yieldable, annular, pressure relieving body 610 radially interposed between the container body 3 and the container cap 6 and defining an elastically yieldable, annular end for the leaked-toner receiving cavity 620, this elastically yieldable closure 610 being operable to at least partially relieve pressure resulting from an accumulation of leaked toner in the leaked-toner receiving cavity 620.

In another distinguishing aspect:

the slip clutch surface 201 provides an annular surface facing generally radially inwardly toward the longitudinal axis 308 of the container body 3;

the shutter plate 202 includes at least one slip clutch engaging surface 202*b* which projects generally longitudinally of the longitudinal axis 308, is spaced radially outwardly therefore, faces generally radially outwardly of this longitudinal axis, and frictionally engages the slip clutch surface 201 in slip clutch driven relation therewith; and the toner container 1 further includes an agitator 205 generally fixedly secured within the container body 3, and operable to induce movement of toner within the container body 3 toward the container body open end 303 in response to rotation of the container body 3 about the agitator 205; and the shutter position control device (generally labeled 300 in FIGS. 12 and 13) comprises a first, shutter stop member 206 carried by the shutter plate 202 and operable to define a first, container closing, rotatable position 208*a* through engagement with the agitator 205; and a second, shutter stop member 207 carried by the shutter plate 202 and operable to define a second, container opening, rotatable position 208*b* through engagement with the agitator 205.

As will be understood, the invention further incorporates method aspects relating to operational characteristics of the structural cartridge features of this enhanced shutter arrangement, as above disclosed and summarized.

Enhanced Agitator Configuration

The present invention provides a uniquely simplified concept for deploying and arranging a toner movement influencing agitator spring 10 OR 205 within a rotating smooth wall cartridge body 3. This concept uniquely deploys a stationary, elastic, preferably metallic, helically coiled spring to influence movement of toner within the cartridge body toward the dispensing opening 604 of the closure cap of the cartridge. This is accomplished by the frictional interaction between the toner body 3 and the smooth internal wall 301*a* (FIG. 1) of the cartridge, which tends to frictionally drag toner into camming cooperation with the sloping sides of the agitator spring. When toner is thus dragged against a slopping camming surface of a spring where the surface appropriately slopes away from the oncoming toner direction movement and toward the outlet portion of the cartridge, the frictionally dragged toner will be influenced to migrate toward the discharge end of the cartridge 1 through the resulting camming cooperation between the dragged toner and the inclined side surfaces 205*c* of the helical coiled spring or agitator 205, for example.

This basic structural concept may be summarized as follows in relation to the FIG. 6 configuration:

A container 1 is presented for supplying toner to an image forming machine, this container comprising:

a container closure cap 210 including an opening 604 operable to discharge toner from the container 1 to an image forming machine 8;

a container body 3 operable to contain toner to be dispensed through the container cap opening 604 to the image forming machine 8, this container body 3 having a longitudinal axis 308 and including a cap connector 204 rotatably securing the container body 3 to the container cap 210 for rotation about its longitudinal axis 308;

a container cap locking device (such as lug 603 of FIG. 2) carried by the container cap 210 and operable to cooperate with an image forming machine 8 to prevent rotation of the container cap 210 relative to this machine 8;

a drive mechanism 209 carried by the container body 3 and operable to induce rotation of the container body 3 when the container body 3 is located within the machine;

this container closure cap 210 including an agitator spring-end support 607, the container body 3 being laterally defined by a smooth walled cylindrical shell 301; and a generally helically coiled, elastic, agitator spring 205 extending axially within the container body 3 and having a free end 205*a* thereof fixedly engaged with the container cap, agitator spring-end support 607;

the thus secured agitator spring 205 being relatively fixed in position with respect to the container cap 210, with the smooth walled cylindrical shell 301 of the container body 3 being rotatable thereabout and cooperable with the agitator spring 205 to induce generally axial movement of toner within the container body 3 toward and through the container cap opening 604*a*.

As will be recognized at this juncture, additionally significant method aspects of the invention are attributed to the operational characteristics of this unique cartridge agitator deployment concept as set forth above.

Common Consequences

In all embodiments of this invention, the shutter plate is free of mounting to, i.e., mounting on, the container cap whereby the slip clutch is operable to effect rotation of the shutter plate. Moreover, in all of these embodiments, the container body open end is free of rotational and sealing engagement with, i.e., relative to, a toner container receiving receptacle of the image forming machine, when installed therein, whereby toner is operable to be disharged sequentially from the container body through its open end and through the toner discharge path provided by the container cap. This toner discharge path remains non-rotatably and non-sealingly disposed relative to the toner container receiving receptacle of the image forming machine when installed therein.

Summary of Advantages, Non Obviousness, and Scope of Invention

The uniquely simplified arrangement of the present invention effects a significant enhancement in the toner dispensing art in departing from the cap mounted shutter arrangement noted at the outset of this disclosure which requires a separate, shutter operating mechanism. In lieu of this complexity and the requirement for positioning and actuating a space-consuming shutter externally of the container or cartridge on the container cap, the present invention employs a uniquely effective slip-clutch shutter plate, journaled at the end of the smooth walled container body which is operated solely in response to rotation of the container body. The operating characteristics of the shutter are able to cause simple rotation of the container body to move the shutter from a closed to an open condition, without in any way inhibiting or limiting rotation of the container body. Relative rotation in a reverse direction between the container body and the cap will serve effectively to restore the shutter to a container closing condition, here again with this closing permitting continuous reverse rotation of the container body, i.e., position sensitivity criteria is avoided.

In one embodiment, the facile shutter installation, afforded by the elastically flexible shutter disc of this invention, provides enhanced simplicity in toner shutter fabrication and installation.

The manufacturing requirements attendant upon the fabrication of a spiral configuration are totally eliminated through the present invention, with a simple, smooth wailed container being operable to induce longitudinal movement of the toner mass out of the container, through frictional interaction between the smooth container wall, the mass of toner, and the relatively stationary helically coiled, agitator spring.

The cantilevered ramp feature of the cap effectively eliminates concavities which would otherwise tend to provide toner accumulating areas, giving rise to a danger of toner broadcasting during container removing operations, with attendant operator and machine soiling dangers.

The leaked toner cavity and associated accumulator features of the invention provide a novel approach to the handling of toner which leaks past the cartridge body and shutter interface during toner dispensing operations, thereby potentially diminishing the "dirtiness" of the environment within the photocopy machine.

The uniquely effective inter-engagement between the slip-clutch shutter and the agitator spring provides a simple yet reliable shutter actuating mechanism, effectively avoiding reliance upon cap-mounted shutter arrangements as contemplated by prior efforts in the cartridge technology art.

Further, the uniquely simple but effective deployment of a fixed agitator spring within a smooth walled cartridge container body serves to cammingly influence axial diversion of frictionally dragged toner axially toward the cartridge outlet in response to the camming influence of the sides of the stationary agitator spring. This avoids manufacturing complications attendant upon the forming of spiral ribs, etc. on container walls, thereby materially simplifying cartridge body manufacturing operations.

In addition, it is to be noted that said shutter plate of this invention is free of mounting to container cap whereby the slip clutching engagement of the slip clutch surface of the container body with the shutter plate is operable to effect the rotation of the shutter plate. Moreover, the container body open end is free of rotational and sealing engagement relative to a toner container receiving receptacle of the image forming machine when installed therein whereby toner is operable to be discharged sequentially from the container body through its open end and through the toner discharge path provided by the container closure cap, which toner discharge path is non-rotatably and non-sealingly disposed relative to the toner container receiving receptacle of the image forming machine when installed therein.

With the state of the art, as noted above, consistently failing to suggest the inventive concepts discussed above, and leading in more complex, divergent directions, the non-obviousness of the invention is substantially evidenced.

Those skilled in the toner dispensing art and familiar with the present disclosure may well envision additions, deletions, substitutions, other modifications or equivalent configurations which would fall within the scope of the invention which is deemed to be set forth in the appended claims.

What is claimed is:

1. A container for supplying toner to an image forming machine, said container comprising:

a container cap including an opening operable to discharge toner from said container to an image forming machine;

a container body operable to contain toner to be dispensed through said container cap opening to said image forming machine, said container body having a longitudinal axis and including a cap connector rotatably securing said container body to said container cap for rotation about said longitudinal axis, a shutter plate rotatably mounted directly on, and at an open end of, said container body for rotation about said longitudinal axis, relative to said container body and having a transfer opening including a toner receiving mouth on an interior side of said shutter plate in continuous communication with the interior of said container body and a toner discharging mouth on the exterior side of said shutter plate in continuous communication with the exterior of said container body, and a closure surface circumferentially displaced from said transfer opening and operable, when aligned with said container cap opening, to substantially close said container cap opening;

a slip clutch rotatably mounting said shutter plate at said open end of said container body and operable to induce friction-induced rotation of said shutter plate about said longitudinal axis of said container body in response to rotation of said container body about said longitudinal axis and relative to said container cap, and permit said rotational movement of said container body about said longitudinal axis to continue with rotational movement of said shutter plate relative to said container cap being arrested;

a shutter position control device operable to define a first rotatable position of said shutter plate relative to said container cap wherein said shutter plate closure surface substantially closes said container cap opening, and a second rotatable position of said shutter plate relative to said container cap wherein said transfer opening of said shutter plate is substantially aligned with said container cap opening, thereby permitting discharge of toner from the interior of said container body through said container cap opening to said image forming machine;

said shutter plate being continuously operable to rotate about said longitudinal axis in one circumferential direction operable to move said shutter plate closure surface out of alignment with said container cap opening, and to rotate about said longitudinal axis in a second circumferential direction, opposite to said first circumferential direction, operable to bring said shutter plate closure surface into alignment with said container cap opening;

a container cap locking device carried by said container cap and operable to cooperate with an image forming machine to prevent rotation of said container cap relative to said machine; and a drive mechanism carried by said container body and operable to induce rotation of said container body when said container body is located within said machine.

2. A toner container as described in claim 1 wherein:

said slip clutch comprises an annular rim integrally formed at said open end of said container body and having a central opening, with said annular rim defining a radially inwardly opening recess, operable to clutchingly receive said shutter plate; and said shutter plate comprises an elastic, laterally flexible, disc operable to be laterally flexed and at least partially inserted through said slip clutch rim opening at least partially into said container body and into partial engagement with said slip clutch, and be at least partially axially withdrawn from said container body so as to restore said shutter plate to an unflexed condition, disposed in annular, friction clutch engagement with said annular rim.

3. A toner container as described in claim 1 wherein:

said container cap includes an agitator spring end supporting post projecting generally axially of said container body and through said shutter plate, with said shutter plate being freely rotatable thereabout;

said container body is laterally defined by a smooth walled cylindrical shell; and said container further includes a generally helically coiled, agitator spring extending axially within said container body and having a free end thereof fixedly engaged with said container cap supporting post;

said thus secured agitator spring being relatively fixed in position with respect to said container cap, with said smooth walled cylindrical shell of said container body being rotatable thereabout and cooperable with said agitator spring to induce generally axial movement of toner within said container body toward said transfer opening of said shutter plate, through said transfer opening of said shutter plate, and through said container cap opening.

4. A toner container as described in claim 1 wherein:

said container cap includes a cantilevered, sloping discharge ramp sloping generally longitudinally outwardly and downwardly, away from said container cap opening, when said toner container is mounted within said image forming machine and operable to define a smoothly configured, toner discharge ramp extending uninterruptedly from said container cap opening to a toner discharge location.

5. A toner container as described in claim 1 wherein:

said slip clutch comprises an annular rim integrally formed at said open end of said container body and having a central opening, with said annular rim defining a radially inwardly opening recess, operable to clutchingly receive said shutter plate;

said shutter plate comprises an elastic, laterally flexible, disc operable to be laterally flexed and at least partially inserted through said slip clutch rim opening at least partially into said container body and into partial engagement with said slip clutch; and be at least partially axially withdrawn from said container body so as to restore said shutter plate to an unflexed condition, disposed in annular, friction clutch engagement with said annular rim;

said container cap includes an agitator spring end supporting post projecting generally axially of said container body and through said shutter plate, with said shutter plate being freely rotatable thereabout;

said container body is laterally defined by a smooth walled cylindrical shell;

said container further includes a generally helically coiled, agitator spring extending axially within said container body and having a free end thereof fixedly engaged with said container cap supporting post;

said thus secured agitator spring being relatively fixed in position with respect to said container cap, with said smooth walled cylindrical shell of said container body being rotatable thereabout and cooperable with said agitator spring to induce generally axial movement of toner within said container body toward said transfer opening of said shutter plate, through said transfer opening of said shutter plate, and through said container cap opening; and said container cap further includes a cantilevered, sloping discharge ramp sloping generally longitudinally outwardly and downwardly, away from said container cap opening, when said toner container is mounted within said image forming machine and operable to define a smoothly configured, toner discharge ramp extending uninterruptedly from said container cap opening to a toner discharge location.

6. A toner container as described in claim 1 wherein:

said container cap includes a toner discharge path providing said opening operable to discharge toner from said container to an image forming machine when installed therein;

said container body includes a slip clutch surface at said open end;

said slip clutch surface of said container body at said open end is disposed in frictional, slip clutching engagement with said shutter plate;

said slip clutch surface of said container body is operable to provide said mounting of said shutter plate directly on, and at said open end of, said container body, and at least in part, define said slip clutch;

said shutter plate is free of mounting to said container cap whereby said slip clutching engagement of said slip clutch surface of said container body with said shutter plate is operable to effect said rotation of said shutter plate; and said container body open end is free of rotational and sealing engagement relative to a toner container receiving receptacle of said image forming machine when installed therein whereby toner is operable to be discharged sequentially from said container body through said open end and through said toner discharge path provided by said container cap, which toner discharge path is non-rotatably and non-sealingly disposed relative to said toner container receiving receptacle of said image forming machine when installed therein.

7. A toner container as described in claim 6 wherein:

said container cap includes a toner discharge path providing said opening operable to discharge toner from said container to an image forming machine when installed therein;

said container body includes a slip clutch surface at said open end;

said slip clutch surface of said container body at said open end is disposed in frictional, slip clutching engagement with said shutter plate;

said slip clutch surface of said container body is operable to provide said mounting of said shutter plate directly on, and at said open end of, said container body, and at least in part, define said slip clutch;

said shutter plate is free of mounting to said container cap whereby said slip clutching engagement of said slip clutch surface of said container body with said shutter plate is operable to effect said rotation of said shutter plate; and said container body open end is free of rotational and sealing engagement relative to a toner container receiving receptacle of said image forming machine when installed therein whereby toner is operable to be discharged sequentially from said container body through said open end and through said toner discharge path provided by said container cap, which toner discharge path is non-rotatably and non-sealingly disposed relative to said toner container receiving receptacle of said image forming machine when installed therein; and said toner container further includes a generally annular, leaked-toner receiving cavity defined by cooperating portions of said container cap, said container body, and a circumferential edge portion of said shutter plate, said leaked-toner receiving cavity being operable to receive toner leaked from the interior of said container body past said slip clutch.

8. A toner container as described in claim 7 wherein:

an elastically yieldable, annular, pressure relieving body is radially interposed between said container body and said container cap and defines an elastically yieldable closure for said leaked-toner receiving cavity, said elastically yieldable closure being operable to at least partially relieve pressure resulting from an accumulation of leaked toner in said leaked-toner receiving cavity.

9. A toner container as described in claim 6 wherein:

said slip clutch surface comprises an annular surface facing generally radially inwardly toward said longitudinal axis;

said shutter plate includes at least one slip clutch engaging surface which projects generally longitudinally of said longitudinal axis, is spaced radially outwardly therefore, faces generally radially outwardly of said longitudinal axis, and frictionally engages said slip clutch surface in slip clutch driven relation therewith; and said toner container further includes an agitator generally fixedly secured within said container body, and operable to induce movement of toner within said container body toward said container body open end in response to rotation of said container body about said agitator; and said shutter position control device comprises a first, shutter stop member carried by said shutter plate and operable to define said first rotatable position through engagement with said agitator; and a second, shutter stop member carried by said shutter plate and operable to define said second rotatable position through engagement with said agitator.

10. A toner container as described in claim 9 wherein said toner container further includes:

a generally annular, leaked-toner receiving cavity defined by cooperating portions of said container cap, said container body, and a circumferential edge portion of said shutter plate, the leaked-toner receiving cavity being operable to receive toner leaked from the interior of said container body past said slip clutch; and an elastically yieldable, annular, pressure relieving body radially interposed between said container body and said container cap and defining an elastically yieldable closure for said leaked-toner receiving cavity, said elastically yieldable closure being operable to at least partially relieve pressure resulting from an accumulation of leaked toner in said leaked-toner receiving cavity.

11. A method for supplying toner to an image forming machine, said method comprising:

providing a container cap including an opening operable to discharge toner to an image forming machine;

providing a container body containing toner to be dispensed through said container cap opening to said image forming machine, said container body having a longitudinal axis and including a cap connector rotatably securing said container body to said container cap for rotation about said longitudinal axis, a shutter plate rotatably mounted directly on, and at an open end of, said container body for rotation about said longitudinal axis, .relative to said container body and having a transfer opening including a toner receiving mouth on an interior side of said shutter plate in continuous communication with the interior of said container body and a toner discharging mouth on the exterior side of said shutter plate in continuous communication with the exterior of said container body, and a closure surface circumferentially displaced from said transfer opening and operable, when aligned with said container cap opening, to substantially close said container cap opening;

providing a slip clutch rotatably mounting said shutter plate at said open end of said container body and operable to induce friction-induced rotation of said shutter plate about said longitudinal axis of said container body in response to rotation of said container body about said longitudinal axis and relative to said container cap, and permit said rotational movement of said container body about said longitudinal axis to continue with rotational movement of said shutter plate relative to said container cap being arrested;

providing a shutter position control device operable to define a first rotatable position of said shutter plate relative to said container cap wherein said shutter plate closure surface substantially closes said container cap opening, and a second rotatable position of said shutter plate relative to said container cap wherein said transfer opening of said shutter plate is substantially aligned with said container cap opening, thereby permitting discharge of toner from the interior of said container body through said container cap opening to said image forming machine;

said shutter plate being continuously operable to rotate about said longitudinal axis in one circumferential direction operable to move said shutter plate closure surface out of alignment with said container cap opening, and to rotate about said longitudinal axis in a second circumferential direction, opposite to said first circumferential direction, operable to bring said shutter plate closure surface into alignment with said container cap opening;

providing a container cap locking device carried by said container cap and operable to cooperate with an image forming machine to prevent rotation of said container cap relative to said machine; and providing a drive mechanism operable to induce rotation of said container body when said container body is located within said machine.

12. A method as described in claim 11 further comprising:

in said slip clutch, providing an annular rim integrally formed at said open end of said container body and having a central opening, with said annular rim defining a radially inwardly opening recess, operable to clutchingly receive said shutter plate; and through said shutter plate, providing an elastic, laterally flexible, disc operable to be laterally flexed and at least partially inserted through said slip clutch rim opening at least partially into said container body and into partial engagement with said slip clutch, and be at least partially axially withdrawn from said container body so as to restore said shutter plate to an unflexed condition, disposed in annular, friction clutch engagement with said annular rim.

13. A method as described in claim 11 further comprising:

in said container cap, providing an agitator spring end supporting post projecting generally axially of said container body and through said shutter plate, with said shutter plate being freely rotatable thereabout;

said container body being laterally defined by a smooth walled cylindrical shell; and within said container, providing a generally helically coiled, agitator spring extending axially within said container body and having a free end thereof fixedly engaged with said container cap supporting post;

said thus secured agitator spring being relatively fixed in position with respect to said container cap, with said smooth walled cylindrical shell of said container body being rotatable thereabout and cooperable with said agitator spring to induce generally axial movement of toner within said container body toward said transfer opening of said shutter plate, through said transfer opening of said shutter plate, and through said container cap opening.

14. A method as described in claim 11 further comprising:

in said container cap, providing a cantilevered, sloping discharge ramp sloping generally longitudinally outwardly and downwardly, away from said container cap opening, when said toner container is mounted within said image forming machine and operable to define a smoothly configured, toner discharge ramp extending uninterruptedly from said container cap opening to a toner discharge location.

15. A method as described in claim 11 further comprising:

in said slip clutch, providing an annular rim integrally formed at said open end of said container body and having a central opening, with said annular rim defining a radially inwardly opening recess, operable to clutchingly receive said shutter plate;

through said shutter plate, providing an elastic, laterally flexible, disc operable to be laterally flexed and at least partially inserted through said slip clutch rim opening at least partially into said container body and into partial engagement with said slip clutch; and be at least partially axially withdrawn from said container body so as to restore said shutter plate to an unflexed condition, disposed in annular, friction clutch engagement with said annular rim;

in said container cap, providing an agitator spring end supporting post projecting generally axially of said container body and through said shutter plate, with said shutter plate being freely rotatable thereabout;

said container body being laterally defined by a smooth walled cylindrical shell;

within said container, providing a generally helically coiled, agitator spring extending axially within said container body and having a free end thereof fixedly engaged with said container cap supporting post;

said thus secured agitator spring being relatively fixed in position with respect to said container cap, with said smooth walled cylindrical shell of said container body being rotatable thereabout and cooperable with said agitator spring to induce generally axial movement of toner within said container body toward said transfer opening of said shutter plate, through said transfer opening of said shutter plate, and through said container cap opening; and in said container cap further providing a cantilevered, sloping discharge ramp sloping generally longitudinally outwardly and downwardly, away from said container cap opening, when said toner container is mounted within said image forming machine and operable to define a smoothly configured, toner discharge ramp extending uninterruptedly from said container cap opening to a toner discharge location.

16. A method as described in claim 11 comprising:

through said container cap providing a toner discharge path which provides said opening to discharge toner from said container to an image forming machine when installed therein;

providing a slip clutch surface at said open end of said container body;

disposing said slip clutch surface of said container body in frictional, slip clutching engagement with said shutter plate;

said slip clutch surface of said container body being operable to provide said mounting of said shutter plate directly on, and at said open end of, said container body, and at least in part, define said slip clutch;

maintaining said shutter plate free of mounting to said container cap whereby said slip clutching engagement of said slip clutch surface of said container body with said shutter plate is operable to effect said rotation of said shutter plate; and maintaining said container body open end free of rotational and sealing engagement relative to a toner container receiving receptacle of said image forming machine when installed therein whereby toner is operable to be discharged sequentially from said container body through said open end and through said toner discharge path provided by said container cap, which toner discharge path is non-rotatably and non-sealingly disposed relative to said toner container receiving receptacle of said image forming machine when installed therein.

17. A method as described in claim 16 comprising:

through said container cap providing a toner discharge path which is operable to provide said opening to discharge toner from said container to an image forming machine when installed therein;

providing a slip clutch surface at said open end of said container body;

disposing said slip clutch surface of said container body in frictional, slip clutching engagement with said shutter plate;

employing said slip clutch surface of said container body to provide said mounting of said shutter plate directly on, and at said open end of, said container body, and at least in part, define said slip clutch;

maintaining said shutter plate free of mounting to said container cap whereby said slip clutching engagement of said slip clutch surface of said container body with said shutter plate is operable to effect said rotation of said shutter plate; and maintaining said container body open end free of rotational and sealing engagement relative to a toner container receiving receptacle of said image forming machine when installed therein whereby toner is operable to be discharged sequentially from said container body through said open end and through said toner discharge path provided by said container cap, which toner discharge path is non-rotatably and non-sealingly disposed relative to said toner container receiving receptacle of said image forming machine when installed therein; and providing a generally annular, leaked-toner receiving cavity defined by cooperating portions of said container cap, said container body, and a circumferential edge portion of said shutter plate, said leaked-toner receiving cavity being operable to receive toner leaked from the interior of said container body past said slip clutch.

18. A method as described in claim 17 comprising:

providing an elastically yieldable, annular, pressure relieving body radially interposed between said container body and said container cap and defining an elastically yieldable closure for said leaked-toner receiving cavity, and permitting said elastically yieldable closure to at least partially relieve pressure resulting from an accumulation of leaked toner in said leaked-toner receiving cavity.

19. A method as described in claim 16 comprising:

through said slip clutch surface, providing an annular surface facing generally radially inwardly toward said longitudinal axis;

in said shutter plate, providing at least one slip clutch engaging surface which projects generally longitudinally of said longitudinal axis, is spaced radially outwardly therefore, faces generally radially outwardly of said longitudinal axis, and frictionally engages said slip clutch surface in slip clutch driven relation therewith; and in said toner container, further providing an agitator generally fixedly secured within said container body, and operable to include movement of toner within said container body toward said container body open end in response to rotation of said container body about said agitator; and through said shutter position control device, providing a first, shutter stop member carried by said shutter plate and operable to define said first rotatable position through engagement with said agitator; and a second, shutter stop member carried by said shutter plate and operable to define said second rotatable position through engagement with said agitator.

20. A method as described in claim 19 comprising:

providing a generally annular, leaked-toner receiving cavity defined by cooperating portions of said container cap, said container body, and a circumferential edge portion of said shutter plate, the leaked-toner receiving cavity being operable to receive toner leaked from the interior of said container body past said slip clutch; and providing an elastically yieldable, annular, pressure relieving body radially interposed between said container body and said container cap and defining an elastically yieldable closure for said leaked-toner receiving cavity, said elastically yieldable closure being operable to at least partially relieve pressure resulting from an accumulation of leaked toner in said leaked-toner receiving cavity.

21. A toner container for supplying toner to an image forming machine, said container comprising:

a container cap including a toner discharge path providing an opening operable to discharge toner from said container to an image forming machine when installed therein;

a container body operable to contain toner to be dispensed through said container cap opening to said image forming machine, said container body having a longitudinal axis and including a cap connector rotatably securing said container body to said container cap for rotation about said longitudinal axis, a shutter plate rotatably mounted directly on, and at an open end of, said container body for rotation about said longitudinal axis, relative to said container body and having a transfer opening, said transfer opening being in continuous communication with the interior of said container body, and in continuous communication with the exterior of said container body, and a closure surface displaced from said transfer opening and operable, when aligned with said container cap opening, to substantially close said container cap opening;

a slip clutch rotatably mounting said shutter plate at said open end of said container body and operable to induce friction-induced rotation of said shutter plate about said longitudinal axis of said container body in response to rotation of said container body about said longitudinal axis and relative to said container cap, and permit said rotational movement of said container body about said longitudinal axis to continue with rotational movement of said shutter plate relative to said container cap being arrested;

a shutter position control device operable to define a first rotatable position of said shutter plate relative to said container cap wherein said shutter plate closure surface substantially closes said container cap opening, and a second rotatable position of said shutter plate relative to said container cap wherein said transfer opening of said shutter plate is substantially aligned with said container cap opening, thereby permitting discharge of toner from the interior of said container body through said container cap opening to said image forming machine;

said shutter plate being continuously operable to rotate about said longitudinal axis in one circumferential direction operable to move said shutter plate closure surface out of alignment with said container cap opening, and to rotate about said longitudinal axis in a second circumferential direction, opposite to said first circumferential direction, operable to bring said shutter plate closure surface into alignment with said container cap opening;

a container cap locking device carried by said container cap and operable to cooperate with an image forming machine to prevent rotation of said container cap relative to said machine; and a drive mechanism carried by said container body and operable to induce rotation of said container body when said container body is located within said machine;

said shutter plate being free of mounting to said container cap whereby said slip clutch is operable to effect said rotation of said shutter plate in response to rotation of said container body; and said container body open end being free of rotational and sealing engagement relative to a toner container receiving receptacle of said image forming machine when installed therein whereby toner is operable to be discharged from said toner container through said toner discharge path provided by said container cap, which toner discharge path is non-rotatably and non-sealingly disposed relative to said toner container receiving receptacle of said image forming machine when installed therein.

22. A method for supplying toner to an image forming machine, said method comprising:

providing a container having a container cap including a toner discharge path providing an opening operable to discharge toner from said container to an image forming machine when installed therein;

providing a container body for said container operable to contain toner to be dispensed through said container cap opening to said image forming machine, said container body having a longitudinal axis and including a cap connector rotatably securing said container body to said container cap for rotation about said longitudinal axis, a shutter plate rotatably mounted directly on, and at an open end of, said container body for rotation about said longitudinal axis, relative to said container body and having a transfer opening, said transfer opening being in continuous communication with the interior of said container body, and in continuous communication with the exterior of said container body, and a closure surface displaced from said transfer opening and operable, when aligned with said container cap opening, to substantially close said container cap opening;

providing a slip clutch rotatably mounting said shutter plate at said open end of said container body and operable to induce friction-induced rotation of said shutter plate about said longitudinal axis of said container body in response to rotation of said container body about said longitudinal axis and relative to said container cap, and permit said rotational movement of said container body about said longitudinal axis to continue with rotational movement of said shutter plate relative to said container cap being arrested;

providing a shutter position control device operable to define a first rotatable position of said shutter plate relative to said container cap wherein said shutter plate closure surface substantially closes said container cap opening, and a second rotatable position of said shutter plate relative to said container cap wherein said transfer opening of said shutter plate is substantially aligned with said container cap opening, thereby permitting discharge of toner from the interior of said container body through said container cap opening to said image forming machine;

said shutter plate being continuously operable to rotate about said longitudinal axis in one circumferential direction operable to move said shutter plate closure surface out of alignment with said container cap opening, and to rotate about said longitudinal axis in a second circumferential direction, opposite to said first circumferential direction, operable to bring said shutter plate closure surface into alignment with said container cap opening;

providing a container cap locking device carried by said container cap and operable to cooperate with an image forming machine to prevent rotation of said container cap relative to said machine;

providing a drive mechanism carried by said container body and operable to induce rotation of said container body when said container body is located within said machine;

maintaining said shutter plate free of mounting to said container cap whereby said slip clutch is operable to effect said rotation of said shutter plate in response to rotation of said container body; and maintaining said container body, open end free of rotational and sealing engagement relative to a toner container receiving receptacle of said image forming machine when installed therein whereby toner is operable to be discharged from said toner container through said toner discharge path provided by said container cap, which toner discharge path is non-rotatably and non-sealingly disposed relative to said toner container receiving receptacle of said image forming machine when installed therein.

23. A toner container operable to contain toner for discharge to an image forming machine, said toner container comprising:

a toner container body, said body having a longitudinal axis, and a toner outlet at one end thereof;

a toner discharge assistant disposed within said container body and operable to influence displacement of toner within said container body toward said one end thereof; and a toner outflow control operable to control the flow of toner through said one end of said container body and out of said container body in response to engaging cooperation of said toner outflow control with said toner discharge assistant;

said toner discharge assistant and said toner outflow control including mutually separable and engageable portions which are separable and engageable in response to rotation of said container body about its longitudinal axis;

said separable and engageable portions of said toner outflow control and said toner discharge assistant being mutually engageable in response to rotation of said container body in one direction of rotation of said container body about its longitudinal axis and operable in response to such engagement to open said toner outlet; and said separable and engageable portions of said toner outflow control and said toner discharge assistant being mutually engageable in response to rotation of said container body in another direction of rotation of said container body, opposite to said one direction, and operable in response to such engagement to close said toner outlet.

24. A toner container as described in claim 23 further including:

an actuating mechanism operable to effect said engaging cooperation of said toner outflow control in response to rotational movement of said toner container about said toner discharge assistant.

25. A method for supplying toner to an image forming machine, said method comprising:

providing a toner container body, said body having a longitudinal axis, and a toner outlet at one end thereof;

providing a toner discharge assistant disposed within said container body and operable to influence displacement of toner within said container body toward said one end thereof; and providing a toner outflow control operable to control the flow of toner through said .one end of said container body and out of said container body in response to engaging cooperation of said toner outflow control with said toner discharge assistant;

said toner discharge assistant and said toner outflow control providing mutually separable and engageable portions which are separable and engageable in response to rotation of said container body about its longitudinal axis;

mutually engaging said separable and engageable portions of said toner outflow control and said toner discharge assistant in response to rotation of said container body in one direction of rotation of said container body about its longitudinal axis and, in response to such engagement, opening said toner outlet; and mutually engaging said separable and engageable portions of said toner outflow control and said toner discharge assistant in response to rotation of said container body in another direction of rotation of said container body, opposite to said one direction, and, in response to such engagement, closing said toner outlet.

26. A method as described in claim 25 comprising:

providing an actuating mechanism operable to effect said engaging cooperation of said toner outflow control in response to rotational movement of said toner container about said toner discharge assistant.

27. A container for supplying toner to an image forming machine, said container comprising:

a container body operable to contain toner to be dispensed said image forming machine, said container body having a longitudinal axis and including a shutter plate rotatably mounted directly on, and at an open end of, said container body for rotation about said longitudinal axis, relative to said container body and having a transfer opening, and a slip clutch rotatably mounting said shutter plate at said open end of said container body and operable to induce friction-induced rotation of said shutter plate about said longitudinal axis of said container body in response to rotation of said container body about said longitudinal axis, and permit said rotational movement of said container body about said longitudinal axis to continue with rotational movement of said shutter plate being arrested;

a shutter position control device operable to define a first rotatable position of said shutter plate wherein said transfer opening is inoperable to transmit toner from the interior of said container body to the exterior of said toner container, and a second rotatable position of said shutter plate wherein said transfer opening is operable to transmit toner from the interior of said container body to said image forming machine;

said slip clutch including a slip clutch surface carried by said container body and comprising an annular surface facing generally radially inwardly toward said longitudinal axis;

said shutter plate including at least one slip clutch engaging surface which projects generally longitudinally of said longitudinal axis, is spaced radially outwardly therefrom, faces generally radially outwardly of said longitudinal axis, and frictionally engages said slip clutch surface in slip clutch driven relation therewith; and said toner container further including an agitator generally fixedly secured within said container body, and operable to induce movement of toner within said container body toward said container body open end in response to rotation of said container body about said agitator; and said shutter position control device comprises a first, shutter stop member carried by said shutter plate and operable to define said first rotatable position through engagement with said agitator; and a second, shutter stop member carried by said shutter plate and operable to define said second rotatable position through engagement with said agitator.

28. A method for supplying toner to an image forming machine, said method comprising:

providing a container body operable to contain toner to be dispensed said image forming machine, said container body having a longitudinal axis and including a shutter plate rotatably mounted directly on, and at an open end of, said container body for rotation about said longitudinal axis, relative to said container body and having a transfer opening, and providing a slip clutch rotatably mounting said shutter plate at said open end of said container body and operable to induce friction-induced rotation of said shutter plate about said longitudinal axis of said container body in response to rotation of said container body about said longitudinal axis, and permit said rotational movement of said container body about said longitudinal axis to continue with rotational movement of said shutter plate being arrested;

providing a shutter position control device operable to define a first rotatable position of said shutter plate wherein said transfer opening is inoperable to transmit toner from the interior of said container body to the exterior of said toner container, and a second rotatable position of said shutter plate wherein said transfer opening is operable to transmit toner from the interior of said container body to said image forming machine;

through said slip clutch, providing a slip clutch surface carried by said container body and comprising an annular surface facing generally radially inwardly toward said longitudinal axis;

through said shutter plate, providing at least one slip clutch engaging surface which projects generally longitudinally of said longitudinal axis, is spaced radially outwardly therefrom, faces generally radially outwardly of said longitudinal axis, and frictionally engages said slip clutch surface in slip clutch driven relation therewith; and within said toner container, providing an agitator generally fixedly secured within said container body, and operable to induce movement of toner within said container body toward said container body open end in response to rotation of said container body about said agitator; and through said shutter position control device providing a first, shutter stop member carried by said shutter plate and operable to define said first rotatable position through engagement with said agitator; and a second, shutter stop member carried by said shutter plate and operable to define said second rotatable position through engagement with said agitator.

* * * * *